US006175632B1

(12) United States Patent
Marx

(10) Patent No.: US 6,175,632 B1
(45) Date of Patent: Jan. 16, 2001

(54) UNIVERSAL BEAT SYNCHRONIZATION OF AUDIO AND LIGHTING SOURCES WITH INTERACTIVE VISUAL CUEING

(76) Inventor: Elliot S. Marx, Keelung Rd., Sec. 2, Alley 1, Lane 79, No. 9, 4th Floor, Taipei (TW)

( * ) Notice: Under 35 U.S.C. 154(b), the term of this patent shall be extended for 0 days.

(21) Appl. No.: 08/909,424

(22) Filed: Aug. 11, 1997

Related U.S. Application Data

(60) Provisional application No. 60/023,776, filed on Aug. 9, 1996.

(51) Int. Cl.[7] ..... H04R 29/00

(52) U.S. Cl. ..... 381/56; 381/61; 84/477 R; 84/484

(58) Field of Search ..... 381/119, 61, 56; 84/477 R, 484, 612, 636, 652, 668, 714, 464 R

(56) References Cited

U.S. PATENT DOCUMENTS 5,036,742 * 8/1991 Youakim ..... 84/601

* cited by examiner

*Primary Examiner*—Ping Lee
(74) *Attorney, Agent, or Firm*—Bromberg & Sunstein LLP

(57) ABSTRACT

A peripheral audio system that is used to monitor or manipulate other signals from an audio source or lighting device is described which includes a detector device adapted to receive audio inputs from the audio sources. The peripheral audio system includes a processor adapted to monitor or manipulate the signals from the audio source. The processor is electrically coupled to a display interface which displays to the user BPM of the audio signals of each of the audio sources as well as provides the user with information regarding the positioning of the beats of each of the audio signals, as well as relative information about the more than one audio signal. The display interface further provides control signals allowing the user to mix the audio signals from the audio sources by providing a beat lock function, which will allow a "beat-to-beat" mix, a pause/play function, which will allow user to make "slam" mix, for example. The detector device is integrated in the preferred embodiment into a dual channel CD player. The detector device may comprise more than one display interface adapted specifically to one implementation such as with the dual CD player or sampler, for example.

7 Claims, 12 Drawing Sheets

UNIVERSAL BEAT SYNCHRONIZATION OF AUDIO AND LIGHTING SOURCES WITH INTERACTIVE VISUAL CUEING

This application claims benefit to U.S. provisional application Ser. No. 60/023,776 filed Aug. 9, 1996.

BACKGROUND OF THE INVENTION

The present invention relates generally to a peripheral audio system such as may be used to monitor and manipulate signals from an audio source. More particularly, the invention relates to a peripheral audio system adapted to detect a tempo and beats of an audio signal from at least one audio source and provide a user a visual interface whereby the user can interactively manipulate the audio signal to perform audio and lighting effects.

Rhythm of music deals with movement and organization of a music piece as related to time, where rhythm is organized according to meter and tempo. While meter is regular reoccurring pulsation of equal length, grouped into measures of two or three beats and compounds of these basic units into longer measures, tempo is instead the speed at which a music piece or its parts are to be performed. Within a given music piece the tempo may vary considerably. A unit of time in music is called a beat, which must reoccur often enough to constitute a series. Because the beat is a unit of time, the beat may not be heard. It is sufficient that the beat be felt or sensed. The tempo or speed of the music piece is a number of beats over time which is expressed herein as beats per minute ("BPM"). Tempo is usually established with a clear assured beat, and the clear assured beat is usually the first beat of each musical measure and is known as a down-beat.

Disc Jockeys ("DJs") skilled in the art of beat mixing work extensively with matching beats of an audio signal to sounds and lighting effects. DJs often try to manipulate or match the sounds within one audio signal to either a sound of another audio signal or a lighting device to produce effects, such as strobe lights that pulse to the beat of a music piece. Another effect is to allow one part of the music piece to flow into another music piece by either having the one audio signal gradually fade into other audio signal, such as is done in a "beat-to-beat" mix. Another effect is to suddenly stop one music piece and start another so that beat flow is not interrupted, such as is done in a "slam" mix. To assist DJs in this task, DJs often use at least one audio peripheral device, such as a beat per minute ("BPM") counter, which provides the DJs with information on the BPM of the audio signal.

One such type of BPM counters is a manual hand-tapping calculators. The manual calculators output the BPM information manually entered by the DJs in a continual manner. However, one draw-back of the manual calculators is that they can not track tempo changes of the audio signal over time, and act more like metronomes.

A "disco beat meter" as described in U.S. Pat. No. 4,300,225 ("225' Patent") entitled "Disco Beat Meter" of George R. Lamb can track the beats of the audio signal as the tempo changes for some music. However, the 225' Patent is aimed at tracking the tempo of disco music. Specifically, the 225' Patent depends on a heavy bass beat, as is present in most disco music, to continue to track the tempo. If an instrument defining the beat is not a heavy bass beat of the drum, the invention of the 225' Patent can not pick up the beat. Further, if the beat is silent for several beats, the Disco Beat Meter defaults to a BPM of 120. Thus, the Disco Beat Meter may misrepresent the BPM of a music piece that has intermittent beats. Further, although the Disco Beat Meter takes two audio sources as input, it only displays when the beats are coincident with each other. This minimizes the ability of DJs utilizing the Disco Beat Meter to mix the beats and change the tempo appropriately.

Another such device entitled "The Don" manufactured by a British company called Intimidation includes an additional feature of a bar graph. This bar graph has 24 LED's total, 8 red LEDS for side 1, 8 green "mix" LEDS, 8 red LEDS for side 2. Each bar graph shifts or "marches" up 1 LED when the sound exceeds a threshold dialed in by the DJ. When the 2 bar graphs are matched, a green LED in the middle lights up where the two sides are coincident. The Don has drawbacks similar to the Disco Beat Meter in that it relies on a heavy, steady bass drum beat and can not track the tempo if the beat is given in other frequency ranges or by other instruments. In addition, as in the Disco Beat Meter if the beats are skipped or intermittently heard, The Don has difficulty tracking the bar graph. As such, the Disco Beat Meter and The Don are not very useful for music pieces that do not have either a disco beat or a steady bass drum beat, particularly when the beats are skipped or intermittently heard as is prevalent in newer music such as hip hop, country, rap, and alternative music.

One attempt to bypass these problems of tracking beats has been to concentrate on the tempo of the audio signal. For example, Pioneer Corporation produces a device that automatically tries to find the BPM also called the tempo of the music. This device provides no means of displaying how well the beats are matched. Mixing without properly matching the beats can produce galloping effects as the tempo may be properly mixed, but the beats are off set by an audible amount which results in a galloping sound. In addition, if a pattern of the music piece is a complex rhythm focusing on the tempo and ignoring the underlying beats may produce an inaccurate BPM.

Another prior art device embodied in a Numark Compact Disc ("CD") player also works best for beats as found in disco music and not in other types of music. Furthermore, the Numark CD player takes full control of the mixing from the DJ once the mixing functions are enabled.

There are also numerous digital samplers available on the market which enable DJs to record, play back, and loop several seconds of music almost instantly. A draw-back of these systems is that the few seconds of sound often can not be accurately captured and looped. Thus, off-line editing is often necessary to produce clean samples which are synchronized to the beat of the music.

Another peripheral device to control lighting devices was constructed so as to illuminate when the lighting devices received an audio signal of an appropriate sound level. One drawback with these lighting devices, however, is that they do not strobe with the beats but only strobe with a magnitude of the sound and accordingly often give unpredictable results. Further drawbacks of this system is its interface, which usually requires tedious manual manipulation. Alternatively, the lighting device is automated so that the DJ can not interactively work with the lighting device.

Accordingly it is an object of this invention to provide a peripheral audio system that can detect beats embodied in an audio signal other than a bass drum beat.

It is another object of this invention to provide a peripheral audio system that tracks the tempo as it is adjusted within the music source.

It is a further object of this invention to provide a peripheral audio system that can track the tempo of a music piece other than disco music.

It is still another object of this invention to provide an audio system that displays to a DJ when the beats of two music pieces are matched not just when a sound magnitude threshold is exceeded.

It is a further object of this invention to provide a peripheral audio system that can be interfaced with lighting devices and adapted to allow the lighting devices to strobe with the beats of a music piece.

It is still a further object of this invention to provide a peripheral audio system to allow DJs to interactively mix more than one audio signal.

It is a further object of this invention to provide a peripheral audio system that can interface with a sampler such that the sampler can accurately capture and loop portions of a music piece.

It is a further object of this invention to provide a peripheral audio system so that a DJ can perform mixing in real time and eliminate off-line editing.

These and other objects of the invention will be obvious and will appear hereinafter.

SUMMARY

The aforementioned problems are overcome and other advantages are provided by the invention which provides a peripheral audio system for use in monitoring and mixing at least one audio signal in conjunction with a second peripheral audio device which can include a sampler, light source, or second audio signal. One such peripheral audio system includes a detector device electrically coupled to and adapted to receive at least one audio signal and generate a beat signal approximating beats of the audio signal. As the audio signal is usually a piece of music, in this way the detector device is adapted to receive piece of music and output the BPM of the music piece also called its tempo as well as indicate when beats of the music fall.

In one implementation, the detector device is coupled to a peripheral device such as a sampler or a lighting device, for example. As such, the detector device instructs the peripheral device to function in accordance with the beats and the BPM of the audio signal. Thus, the peripheral device can, in the case of a lighting device, strobe in accordance with the BPM of the music piece.

In a second implementation, the BPM and the beats of the music piece are displayed on a display interface to a user. Thus, enabling the user to utilize the BPM of the music piece and the beats to mix the music piece with another music piece or itself as desired.

In the preferred embodiment, the detector device is adapted to receive two audio signals which are normally two pieces of music. As such, the display interface displays the BPM of each of the audio signals as well as the beat of each of the audio signals. In this implementation, the display interface also displays a beat off-set between the two audio signals as well as a tempo off-set between the two audio signals. This allows a user to ascertain whether the two audio signals are playing at the same tempo and whether the individual beats of the two audio signals coincide to facilitate mixes, such as a "beat-to-beat mix" or "slam" mix or fade-in and fade-out applications as is well known in the art. Utilizing the tempo off-set display and control features provided on the display device, a user can alter the tempo of one of the audio signals to match the tempo of the other audio signal, as is commonly done when mixing music. The user can also alter the positioning of the beats of one of the audio signals to coincide with the beats of the second audio signal or its off-beats as desired. Thus, producing acceptable clean "beat-to-beat" mixes of the music.

The detector device determines the BPM of an audio signal by collecting the audio signal over time and determines which sounds within the audio signal constitute sound impacts. The detector device utilizes the sound impacts to find the beats of the audio signal. It does this by first comparing a portion of the sound impacts of the audio signal against a note structure for a range of BPMs, where the note structure has measures which contain notes that are positioned to correspond to a possible BPM. In the preferred embodiment, the note structure is a sixteenth note structure. The detector then quantifies the match of the sound impacts to the notes.

In the preferred embodiment, the detector also compares a portion of the sound impacts against a second note structure and sums the number of matches of the sound impacts with the second note structure. The detector also sums a number of times the sound impacts fall at the same position relatively within measures of the second note structure. This number indicates to the beat detector that the sound impacts repetitively fall to some extent on notes of each of these measures this number and the number of matches throughout the audio signal over time. Both of these sums are scaled so that a meaningful comparison of the sums each can be made throughout a range of possible BPM. The BPM of the audio signal is one of the possible BPM having a higher scaled sum. In the preferred embodiment, to further narrow the choice of possible BPM, the detector device evaluates an off-set difference of each of the sound impacts from the notes of the note structure for each possible BPM. The offset difference is then multiplied by the magnitude of each of the sound impacts to generate an offset. This process is repeated for each of the sound impacts over the period of the sampled audio source. The BPM is the one with a smaller offset that has a higher scaled sum.

Once the detector device has found the BPM of the audio signal and the user has instructed the detector device to lock onto the audio signal, the detector device continually tracks the BPM as it changes over time, thus, providing a user with a continuous BPM of the audio signal. The detector device performs this function by searching for the sound impacts over time that fall near the beats of the audio signal. When a sound impact falls outside a pre-determined time region surrounding the beats of the audio signal, the detector device will shift subsequent beats, either the amount of the displacement of the sound impact or half of a maximum beat-shift region, where the maximum beat-shift region is determined to allow adequate tracking of the beats. In this way, the detector device provides continuous BPM of the music piece and continuous beats of the music piece to a user.

If, however, the detector device is in error and either the BPM or the beats of the audio signal are incorrect, the audio peripheral device provides for a manual override that allows the user to input interactively the BPM of the music piece or individual beats of the music. The user can also verify that the BPM and beat locations are correct.

In a further implementation, the detector device is integrated with a CD player or other digital audio device. In this implementation, the display interface also includes a marching bar graph that provides a visual indicator of tempo variations of an audio source. More particularly, the bar graph uses an LED for each beat for each measure of music, thus further facilitating the ability to mix music per beat. In addition, the peripheral audio system also includes a prediction mechanism that is adapted to sample the output from the CD player so as to predict the location of beats of the audio signal prior to the playing of the audio signal.

In further aspects, the invention provides methods in accordance with the apparatus described above. The aforementioned and other aspects of the invention are evident in the drawings and in the description that follows:

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

While the present invention retains utility within a wide variety of audio applications and may be embodied in several forms, it is advantageously employed when integrated with two audio sources such as that provided by a dual channel compact disk ("CD") player. Though integration with the CD player is the form of the preferred embodiment and will be described as such, this embodiment should be considered illustrative and not restrictive. An example of another device in which this invention retains utility is when the peripheral system is incorporated into a sampler device.

Figure 1:
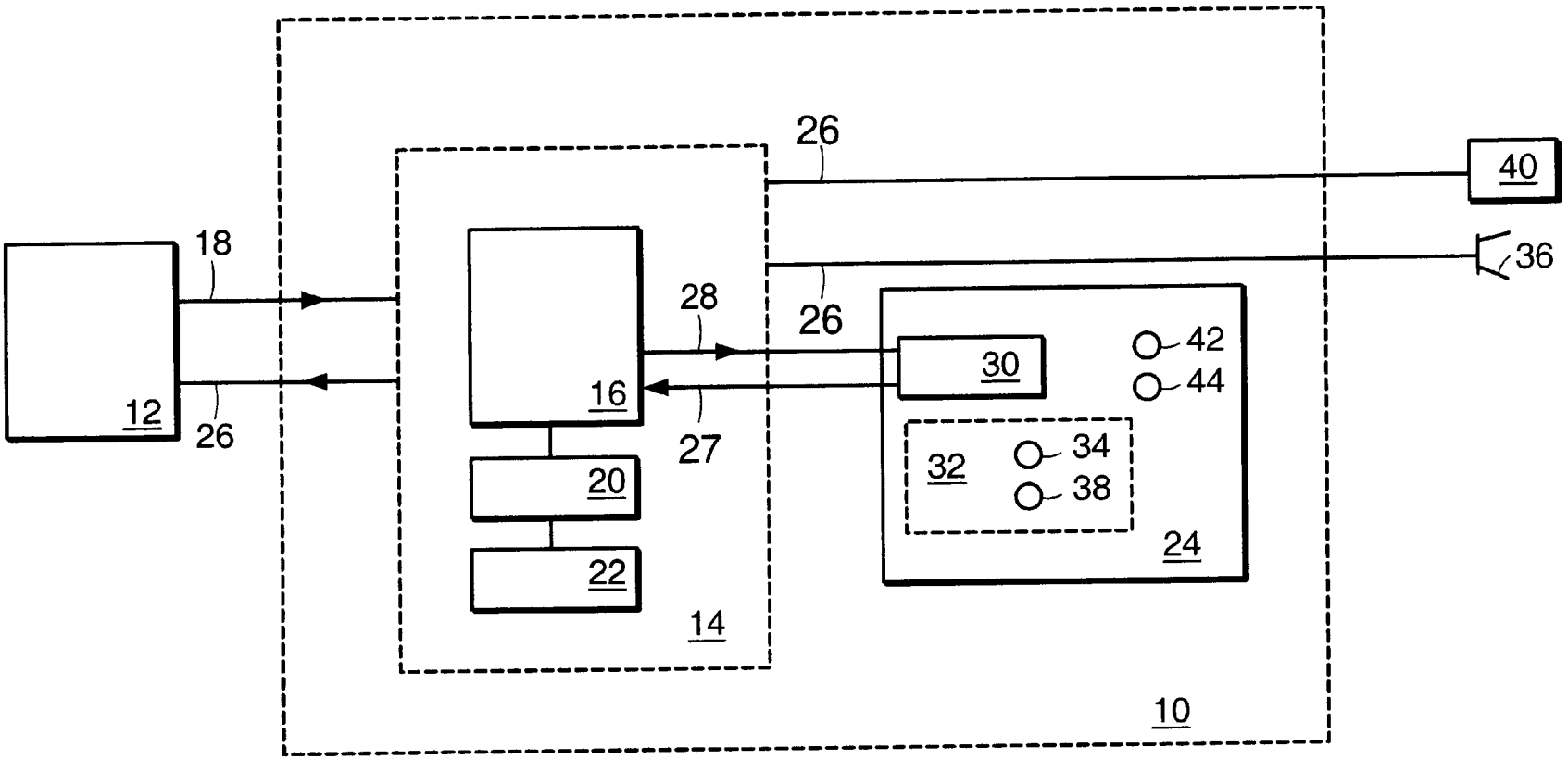
FIG. 1 is a box diagram of a one input audio peripheral device in accordance with one embodiment of this invention.

FIG. 1 shows a peripheral system 10 according to one embodiment of the present invention. As shown, it is a detector device 14 or beat per minute ("BPM") counter that is electrically coupled to an audio source 12 and adapted to receive an audio signal 18 from the audio source 12. In normal use, the audio source 12 is either playing a recorded music piece or it is a microphone that receives a music piece. The music piece is translated into the audio signal 18 by the audio source 12, and the audio signal 18 is then received by the detector device 14.

The detector device 14 processes the audio signal 18 and generates, among other items, a "best fit" of a BPM of the audio signal 18. The detector device 14 communicates the BPM as a control signal 28 to a display interface 24 incorporated within the peripheral system 10, upon which the BPM is displayed in a BPM display 30. In this way, a disk jockey ("DJ") can use the BPM to perform mixes of the music piece or change the tempo of the music piece represented by the audio signal 18.

The detector device 14 includes a processor 16, which in the preferred embodiment performs computations required for the peripheral system 10. It should be apparent that the processor 16 can be implemented using software or other discrete hardware to perform the same functions. Preferably, the processor 16 is a digital signal processor or other high speed microcontroller such as a Zilog Z89371, for example.

In this embodiment, the detector device 14 also includes a storage device 22 coupled to the processor 16 through a communications interface 20. When present, the storage device 22 provides the peripheral system 10 with additional memory so that the peripheral system 10 can perform more memory dependent functions, such as those commonly performed by a sampler, for example, which require temporary storage of the audio signal 18 prior to processing the audio signal 18. The storage device 22 can be a dynamic random access memory ("DRAM") chip, static random access memory ("SRAM") chip, or any other well known storage device in the art.

In some applications the peripheral system 10 processes the audio signal 18 such that a resulting processed audio signal represents an altered music piece. In such applications, the peripheral system 10 is adapted to transmit output signals 26 to the audio source 12, whether they are analog or digital, to enable the audio source 12 to play the processed audio signal or use the output signals 26, as the case may be. The output signals 26 can contain an audio signal or control signals, and is substituted for the unprocessed signals originally used in or from the audio source 12. For example, when the peripheral system 10 alters the tempo of a music piece, the peripheral system 10 transmits the output signals 26 containing the altered music piece back to the audio source 12.

A speaker 36 can also be electrically coupled to the peripheral system 10, although not necessarily, to output the music piece. It should be apparent that the speaker 36 is used only when an audio system does not have a means too play the audio signal 18. As such, the peripheral system 10 does not necessarily have to be adapted to transmit the output signal 26 to a speaker. It should also be apparent that the speaker 36 could be a tape deck or other component of an audio system dependent upon a particular application of the peripheral system 10.

The detector device 14 can also be coupled to one or more peripheral devices 40, where a peripheral device may be a sampler or a strobe lighting device, for example. The peripheral device 40 can also be integrated into the peripheral system 10 such that the peripheral system 10 includes the detector device 14 and the peripheral device 40. This is particularly useful for a strobe lighting device, as most commercially available strobe lighting devices are designed to strobe in accordance with sounds that exceed a certain threshold. In contrast, a strobe lighting device coupled to the detector device 14 can also provide lighting effects cued not to sound magnitude but to beats of the audio signal 18.

Turning back to the display interface 24, the display interface 24 is adapted to function as a control interface. It allows the user to activate control features 32 directing the detector device 14 to analyze or alter the audio signal 18, such as by activating a beat assist mode or sync lock mode, both or which are further described with reference to FIG. 6A and FIG. 6B. Manipulations of the control features 32 by the user are transmitted to the detector device 14 as digital inputs 27.

In addition to acting as a control interface, the display interface 24 is also adapted to provide the user with varied types of information regarding the audio signal 18 to facilitate the mixing process. As such, the display interface 24 not only displays the BPM of the music piece but it also displays the location in time of beats of the audio signal 18 by illuminating and deilluminating a beat LED 42 which appears as "flashing" upon each beat of the music piece.

The display interface 24 also provides the user with the location in time of sound impacts in the music piece by flashing a sound impact LED 44. In the preferred embodiment, the beat LED 42 is red and the sound impact LED 44 is green to provide visual distinction for the user.

As used herein "sound impacts" are positions within an audio signal that have a magnitude and represent sound, whether it be noise or music. Sound impacts can represent beats, off-beats or other notes that are not beats. Sound impacts can also include noise, such as a dropping of a needle onto a record, for example.

Figure 2:
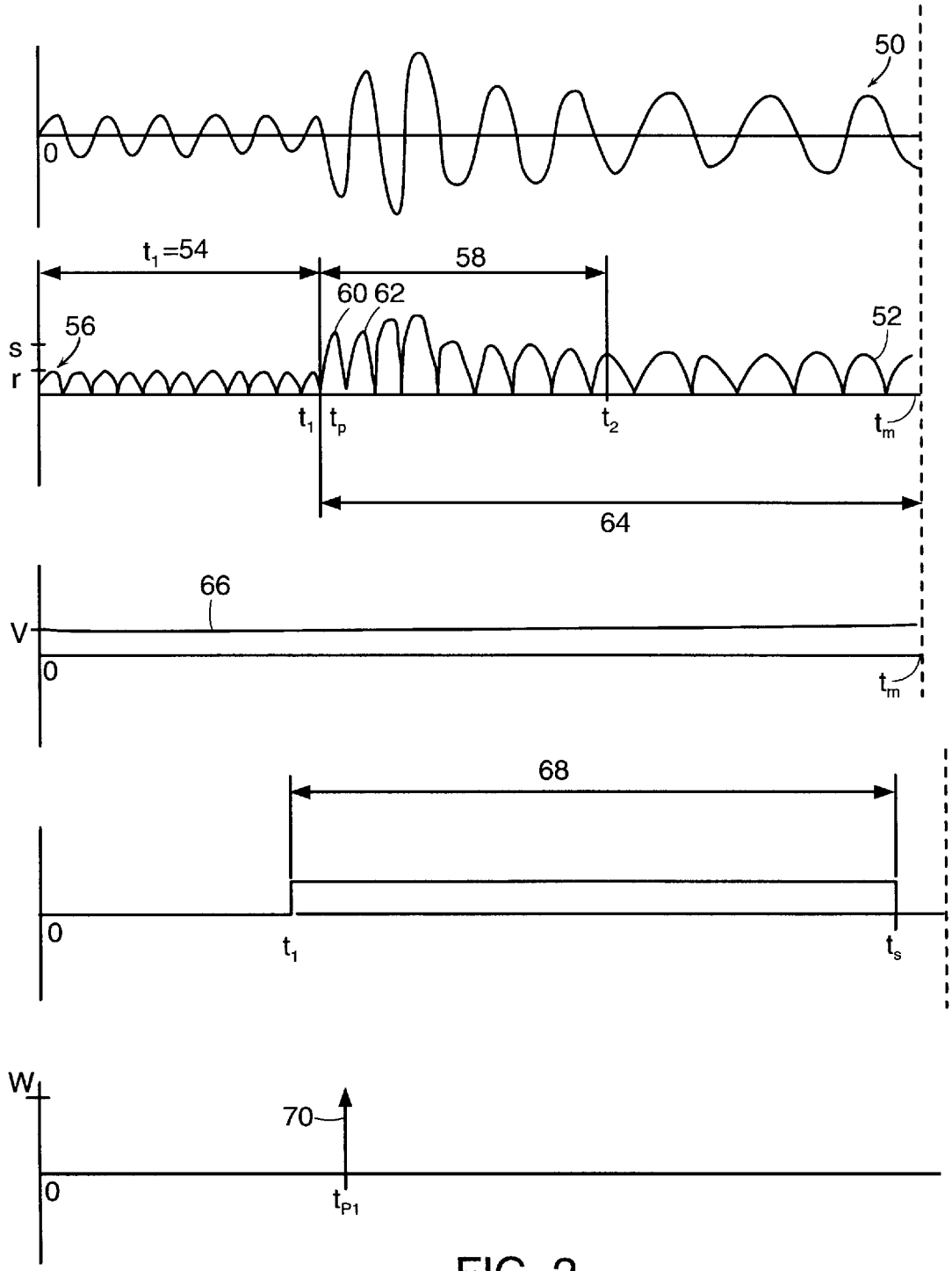
FIG. 2 is a graph of how the peripheral device of FIG. 1 finds a sound impact within an audio signal.

The detector device 14 analyzes the audio signal 18 to find the sound impacts, as is more fully described with reference to FIG. 2. On FIG. 2, graph 50 illustrates an example of a relatively clean audio signal 50, such as may be received by the processor 16.

To determine what peak sounds, also called potential sound impacts, qualify as sound impacts, the detector device 14 analyzes the audio signal 18 over a finite time period and performs three steps on the collected data.

To implement these steps the audio signal 50 is first rectified, where the rectified audio signal is shown in graph 52. The detector device 14 searches successive time intervals 54, 58 for peak sounds. Although the time intervals, as shown, are of equal length they can be of varied lengths. Shorter time intervals will detect more beats, but are more likely to fool the detector device 14 by low frequency tones. In contrast, longer time intervals will reduce a number of sound impacts detected in the audio signal. As such, in the preferred embodiment the time interval is 32 ms as it has been empirically shown to compromise between these two drawbacks.

The detector device 14 looks for peak sounds 56, 60 within the successive time intervals 54, 58. When the detector device 14 finds peak sounds within successive time intervals, the detector device 14 compares the peak sound 60 of the second time interval 58 to the peak sound 56 of the first time interval 54. To qualify as a sound impact, a magnitude of the peak sound 60 of the second time interval 58 which is 's' must exceed a magnitude of the largest peak sound 56 of the previous time interval 54 which is 'r'. 's' must exceed 'r' by a minimum amount to prevent false triggers.

If the peak sound 60 of the second time interval 58 is of a greater magnitude than the peak sound 56, as is shown in the example, the detector device 14 looks for a subsequent peak sound 62 in the second time interval 58 and performs the same analysis. It should be apparent that the detector device 14 can continue this process and look for more peaks within each time interval to produced an analysis absent the effects of noise, however, such an analysis may miss more sound impacts within the audio signal then the described abbreviated analysis.

As such, in the preferred embodiment the detector device 14 at this point then compares the magnitude of the first peak sound 60 and the subsequent peak sound 62 within the single time interval 58 against an average of a rectified audio signal. The average of the rectified audio signal is shown by graph 66 that has a magnitude, v, and is the rectified audio signal passed through a simple low pass filter. In the preferred embodiment, the low-pass filter has a 1 second time constant, although other implementations or hardware can be used to find the average of the audio signal over a given time.

Lastly, if the magnitude of the first peak sound 60 and the subsequent peak sound 62 exceed the average magnitude, v multiplied by a scale factor, then the detector device 14 verifies whether the location in time of the first peak sound 60 and the subsequent peak sound make them likely to be sound impacts. Multiple sound impacts are analyzed to minimize effects due to noise caused by record scratches and the dropping of a record needle, for example.

In addition, the detector device 14 will examine if the potential sound impact is within an impermissible interval 68 of a previous sound impact. The impermissible interval 68 allows the detector device 14 to minimize an effect of resonance. For example, graph 68 shows an impermissible interval 68 of a sound impact 70.

If all criteria are met, the detector device 14 determines that it has found a sound impact 70 at time $t=t_{p1}$, which corresponds to the initiation of the first peak sound 60. The sound impact 70 is also given a magnitude, 'w' as shown the y-axis, where the magnitude is the average power of the sound impact 70 over a magnitude interval 64. The magnitude interval 64 is 64 ms in the preferred embodiment. It should be apparent, however, that the magnitude interval 64 can be longer or shorter and vary according to the type of music or vary to match empirical data.

Once the detector device 14 has found sound impacts for at least a portion of the audio signal 18, it then cycles through various possible BPM to determine which BPM is the "best fit" for the audio signal 18. As used herein, the BPM that is the best fit is the one chosen by the detector device 14 in accordance with the method and its variations as described below. Preferably the best fit is exact, but it has been shown empirically to be substantially within plus or minus 1% for most dance music, although it should be apparent that a larger range is acceptable. Hereinafter, the "best fit" BPM will be referred to as the BPM.

In the preferred embodiment, the user selects one of three ranges of possible BPMs to the BPM of the audio signal 18:

a slow range including 50–95 BPMs; a medium range including 80–150 BPMs; and a fast range including 130–199 BPMs. The top end of each range is less than twice the low end of the range, so that the peripheral system 10 can easily distinguish each BPM within each range. It should be apparent, however, that these ranges can be modified or the detector device 14 can perform checking functions to allow the range of BPM to be two times the lowest BPM. In the preferred embodiment, the default range will be 80–150 BPM as most dance music falls within this range.

Figure 3A:
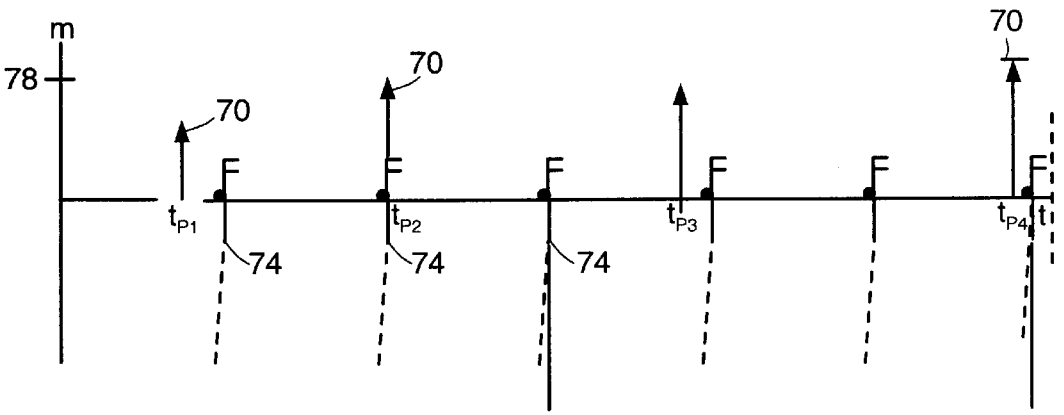
FIG. 3A is a graph of sound impacts of an audio signal overlaid with a note structure.
Figure 3B:
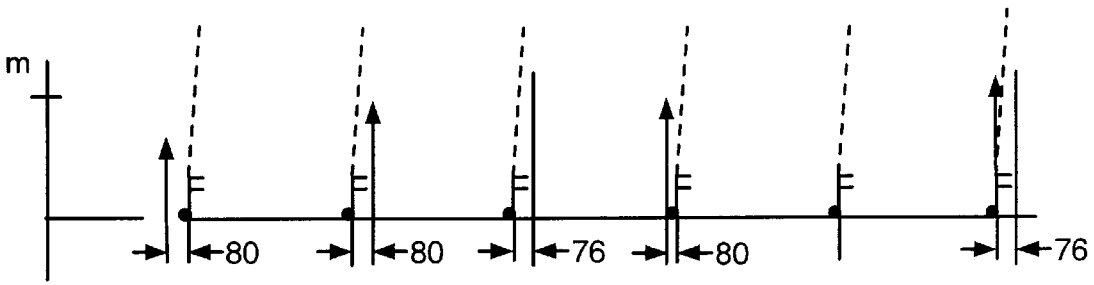
FIG. 3B is a graph of the sound impacts of FIG. 3A overlaid with the same noted structure after it has been shifted.
Figure 3C:
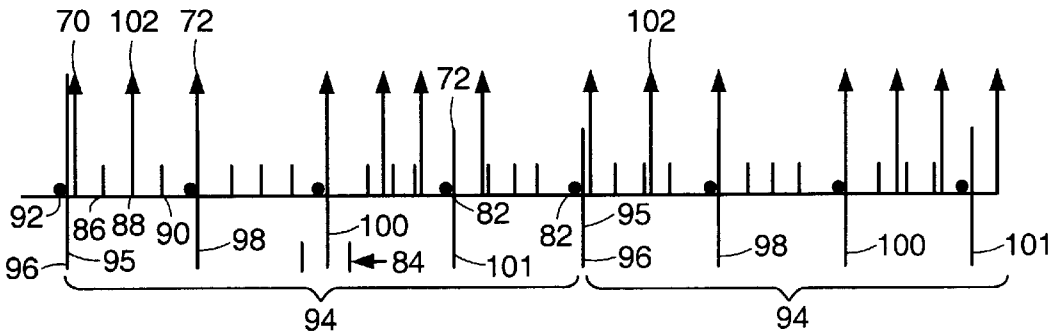
FIG. 3C is a graph of the sound impacts of an audio signal overlaid with a quarter note structure.

Which ever range is chosen, the detector device 14 cycles through each BPM within that range and determines which one of the possible BPMs most likely corresponds to the audio signal 18. FIGS. 3A through 3C illustrate graphically how the detector device 14 finds the corresponding BPM of the audio signal 18 in the preferred embodiment.

As hereinafter described, first the detector device 14 collects audio information over a suitable period of time, which in the preferred embodiment is 4–6 seconds. The detector device 14 determines a location and magnitude of any sound impacts 70 within that time, and then tries to match the sound impacts 70 with at least one note pattern at each BPM in the range being tested. The detector device 14 compares whether the sound impacts 70 match the at least one note pattern by comparing the distance of the sound impacts 70 from notes of the at least one note pattern as well as comparing the magnitude of the sound impacts 70 that do not coincide with the notes of the at least one note pattern. Further, the detector device 14 ascertains whether sound impacts 70 are repeated in a patterned manner throughout at least one note pattern at each BPM in the range being tested.

Next, the detector device 14 sums a number of the matches of the sound impacts with at least one the note pattern and a number of patterned matches to compare the sums, after scaling, as hereinafter described. The detector device determines the BPM to be the BPM that has a high scaled sum of matches of the sound impacts to the note pattern and more matches of the sound impacts 70 that have a large magnitude to the note pattern.

More specifically, a sixteenth-note structure 74, corresponding to each BPM in the range being tested, is overlaid upon the time period being tested as is shown in FIG. 3A. It should be apparent that the sixteenth-note structure 74 can be any note pattern fitting the BPM being tested, such as a half-note, or quarter-note structure, for example, having the same time signature.

Then the sixteenth note structure 74 is shifted so as to reduce, preferably to minimize, the average distance of sound impacts 70 from the sixteenth note structure 74. This is in effect trying to best fit a metronome to a drumbeat which may drift ahead or behind, such as during live performances.

The detector device 14 can quantify the correctness of the match of the sixteenth-note structure 74 with the sound impacts 70 by evaluating how far each of the sound impacts 70 are displaced from the sixteenth-note structure 74, as is represented by an off-set distance 80, while concurrently evaluating the magnitude of the sound impacts 70 so off-set. More particularly, the correctness of the match can be quantified by an off-set sum, where the off-set sum is the sum of the magnitude of each of the sound impacts 70 multiplied by the respective off-set distance 80 of each sound impact 70 from a note of the sixteenth-note structure 74. Thus, when the off-set sum is smaller, the sound impacts will be better matched to the sixteenth-note structure 74. As the off-set sum is a function of both the magnitude of the sound impacts 70 and the off-set distance 80, a smaller sum reflects either (1) a closer match between the sound impacts 70 and the sixteenth-note structure 74 or (2) a close match of the sound impacts 70 having a larger magnitude to notes of the sixteenth-note structure 74. On the other hand, a larger off-set sum would indicate that the sixteenth-note structure 74 is not well matched to the sound impacts of the song.

As previously described, more than one note structure corresponding to each possible BPM within the range is compared against the sound impacts 70 prior to determining an appropriate BPM of the audio signal 18. In the preferred embodiment, the second note structure used is a quarter-note structure 82 as is further shown on FIG. 3C. Again, the quarter-note structure 82 can also be the sixteenth-note structure 74, or other note structure, having various beats per measure.

The quarter-note structure 82 is imposed over the sound impacts 70 such that the sound impact having the greatest magnitude falls on a quarter note. Sound impacts 70 which lie within a limited number of seconds or fractions thereof surrounding each quarter note are designated as coincident beats 72 by the detector device 14. In the preferred embodiment coincident beats are defined as beats within plus or minus 1/32 note of the quarter note in closest proximity to the sound impact 70, where this range is also called a coincident beat range 84.

The detector device 14 then counts a number of coincident beats 72 during the sampled time period prior to and after the sound impact having the greatest magnitude 78. The detector device 14 then shifts the quarter-note structure 82 to a second starting point 86 which is one sixteenth note from its initial position and counts the number of coincident beats 72 against the shifted quarter-note structure. The detector device 14 repeats the shifting and the coincident beat counting process until it has shifted the quarter-note structure a whole quarter note from the first starting point 92 at quarter note 95 to the second starting point 86, to the third starting point 88, and then to the fourth starting point 90 at quarter note 98. The detector device 14 will then choose as the appropriate quarter-note structure for at least one of the possible BPMs the one having a starting point 92, 86, 88, 90 that results in the greatest number of coincident beats 72.

As previously described, the detector device 14 also quantifies whether patterns of the sound impacts 70 are repeated from measure to measure. To collect this information, the detector device 14 places a measure holder at the starting point 92, 86, 88, 90 that resulted in the greatest number of coincident beats 72. In the example, the starting point 92 is chosen. As such, a measure holder 96 is positioned at the start of each measure 94 of the quarter-note structure 82 throughout the time period sampled.

The detector device 14 then counts a number of times the sound impacts 70, whether they were defined as coincident beats 72 or not, are the same distance away from the measure holder 96 in each measure of the music piece. In the example, six sound impacts fall at the same position relative to the measure holders 96 of each measure, this sum is also called the number of patterned matches. The detector device 14 may count the number of times sound impacts are within plus or minus 12.5% of one of the quarter notes 95, 98, 100, 101 or the sixteenth notes to decrease the amount of information collected.

Utilizing this summed information, the detector device 14 then determines an appropriate BPM for the audio signal 18. The BPM so determined is preferably exact. Higher accuracy can be achieved by determining the BPM over a longer period of time, such as 10 or 15 seconds, but this longer period of time begins to approach a time period used by DJs to manually count beats. Accordingly, in practice this auto function is less useful for longer time periods. In addition, manual overrides are provided to aid the user in altering the BPM or verifying the BPM.

To determine the BPM, first the number coincident beats and the number of patterned matches are summed for each BPM within the range. The resulting sum at each BPM is scaled so that a relative comparison between the sums is meaningful. For instance, if the BPM of the sixteenth-note structure and the quarter-note structure was 150 BPM there are more sixteenth notes and quarter notes that can match the sound impacts than would be present in a sixteenth-note structure and a quarter-note structure corresponding to an 80 BPM. As a result, if the scale factor 150 BPM is 1, the scale factor for 80 BPM is 150/80.

The beat detector 14, however, does not just use a highest scaled sum. Instead, the beat detector 14 chooses as the BPM one having one of the higher scaled sums that also has the smallest offset sum. The offset sum was described previously as being the sum of the average powers of the sound impacts 70 multiplied by the absolute values of their respective offsets from the nearest sixteenth note of the sixteenth-note structure 74. In a preferred embodiment, the smallest offset is the determinative factor, thus emphasizing the characteristic of music that beats are normally found by strong instruments having a large magnitude for each sound impact. It should be apparent that the determining criteria could be a combination of the offset sum and higher scaled sums, or higher scaled sum alone without departing from the scope of this invention.

Furthermore, although the preferred method of determining the BPM is described above, it should be apparent that without departing from the scope of this invention any of the steps described above can be altered, more rigorously applied or even omitted and compensated for by a more rigorous application of another step or more iterations. It should also be apparent that a less accurate BPM can be found that is sufficient for less precise applications by omitting steps without using either more iterations of the remaining steps or shorter time intervals or more complete counting of matches.

Figure 4A:
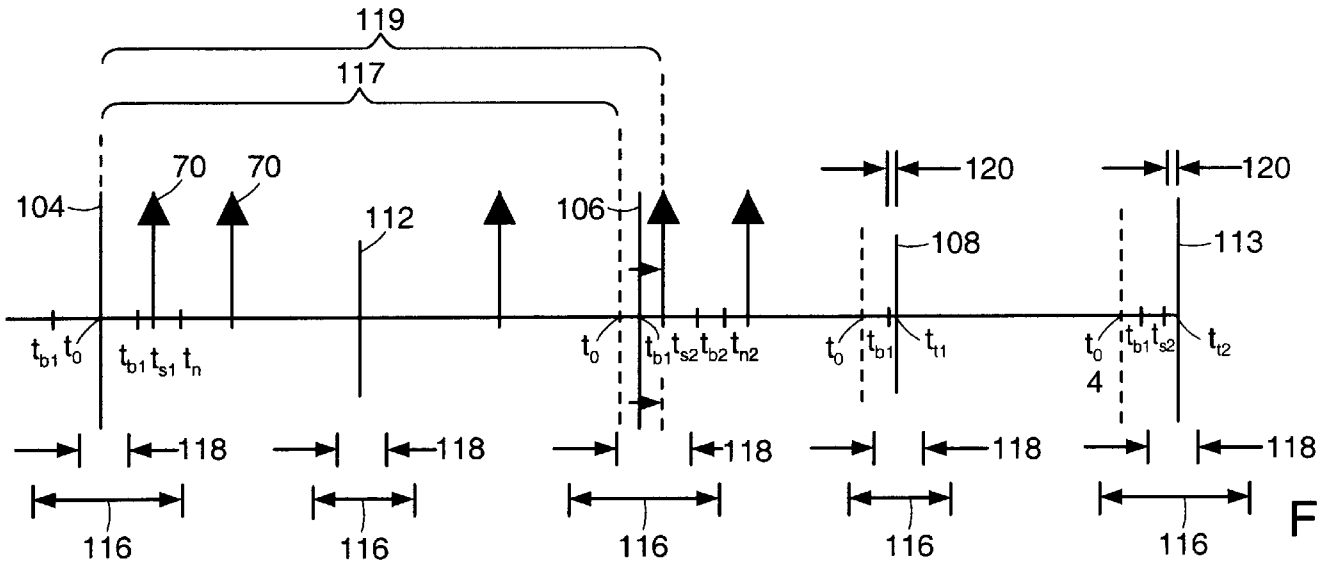
FIG. 4A is a graph of how the peripheral device of FIG. 1 updates a BPM of an audio signal and tracks beats of the audio signal.

To provide a continuous BPM display of the audio signal 18, and update the flashing of the beat LED 42 and the sound impact LED 44 to correspond to the changes in the music piece, the detector device 14 must track the beats of the music piece. The method employed to track the beats of the music piece is further described with reference to FIG. 4A and FIG. 4B. The detector device utilizes the BPM of the music to map, beats 114 over time and compare the beats against the sound impacts 70 of the music piece at it is playing. More particularly, the detector device 14 searches for sound impact 70 within a region of the beats 114 to determine whether the beats 114 are still positioned appropriately. If the beats 114 are determined to no longer be positioned appropriately, they are selectively shifted to correspond to the sound impacts 70 of the music piece over time. Not only are the beats 114 shifted, but the tempo of the music piece is similarly selectively shifted depending on the location of the sound impacts 70 over time.

Specifically, the detector device 14 searches for sound impacts 70 that fall within a time interval denoted as a near region 116, surrounding the beats 114. A sound impact 70 falling within the near regions 116 are considered beats 114 of the music piece. The remaining sound impacts 70 are ignored except for off-beats that are described in FIG. 4B. In the preferred embodiment, the near region 116 is plus or minus 15% of a quarter note for beats and plus or minus 10% for off beats. The near region 116 can be longer or shorter without departing from scope of the invention; however, the near region 116 was determined empirically to appropriately pick up and track the beats 114 of the music.

The detector device 14 also defines a beat shift region 118 from the beats which is in the preferred embodiment, plus or minus 7.5%, also as determined empirically. The beat-shift region 118 designates the maximum amount one of the beats 114 is allowed to shift in the next subsequent beat of the measure. Initially, the beat-shift region 118 is a shorter time period to prevent the detector device 14 from responding to beats 114 that do not line up with the actual tempo of the music piece. For instance, if a sound impact 70 is located within the near region 116 of an initial beat 104, the maximum amount of time a next subsequent beat 106 will be shifted is to an end of the beat-shift region 118 represented by $t=t_{B1}$ or $t=t_{-B1}$.

Because the sound impact 70 following the initial beat 104 falls at $t=t_{S1}$ within the near region 116 prior to $t=t_N$, but farther than the beat-shift region 118 represented by $t=t_{B1}$, the subsequent beat 106 is shifted from its initial position at $t=t_0$ the maximum amount being the end of the beat-shift region 118 at $t=t_{B1}$. If, however, the sound impact 70 had fallen prior to $t=t_{B1}$ and thus within the beat-shift region 118, then the subsequent beat 106 would have been shifted by amount the sound impact 70 fell from the initial beat 104.

In either case, not only would the subsequent beat 106 be shifted by that amount, but so would every beat in the audio signal thereafter, as is illustrated by a shift of a third beat 113 from its initial position at $t=t_0$ to a distance at least as far as the beat-shift region 118. The shifting of the beats 114 in this manner does not affect the underlying tempo or the BPM of the music piece as each of the beats 114 is shifted by the same amount.

As illustrated, no further sound impacts 70 fall within the near region 116 of the initial beat 104. Thus, the detector device 14 evaluates the subsequent beat 106 for sound impacts 70 falling within its near region 116. The near region 116 of the subsequent beat 106 remains the same, and will always remain the same positioned symmetrically about each of the beats 114.

However, the beat-shift region 118 changes. The beat-shift region 118 increases or decreases depending on the relative location of the sound impact 70 to a prior beat. More particularly, if a prior sound impact 70 fell outside the beat-shift region 118 but within the near region 116 so that it was not ignored, the beat-shift region 118 of the next beat expands to a fast-tracking-range in a direction of the displacement of the sound impact 70 relative to the prior beat. The fast-tracking range is illustrated at the subsequent beat 106. As such, the beat-shift region 118 designates a larger maximum amount, $t=t_{B2}$ that the third beat 113 is allowed to be shifted. The expansion of the beat-shift region 118 to a fast-tracking-range accommodates for changes in the BPM that may be occurring in the music piece.

Using the altered beat-shift region, the detector device 10 evaluates the sound impacts 70 surrounding the subsequent beat 106. As illustrated, the sound impact 70 following the subsequent beat 106 falls within the beat-shift region 118 at $t=t_{S2}$. As it is the only sound impact 70 within the near region 116 surrounding the subsequent beat 106, the third beat 113 and all other beats 114 following in time will be shifted by an offset distance represented by $t=t_{S2}$, which is the lesser of the maximum beat shift permitted by the beat-shift region 118 and the displacement of the sound impact 70 from the subsequent beat 106. As such, the third beat 113 has been shifted from its initial position, at $t_0$, to $t=t_{B1}+t_{S2}$, where the shift to $t_{B1}$ was owing to the location of the sound impact 70 falling beyond the beat-shift region 118 of the initial beat 104 and the shift to $t_{S2}$ was owing to the location of the sound impact 70 relative to the subsequent beat 106.

Owing to the position of the sound impact 70 following the subsequent beat 106 the beat-shift region 118 surrounding the third beat 113 is changed. As the sound impact near the subsequent beat 106 fell within the beat-shift region 118, the beat-shift region 118 for the third beat 113 is restored to the default of the slow-tracking-range and, as before, it is designed to keep the BPM from following sound impacts 70 that do not define the tempo.

At this time, the underlying tempo of the music piece still hasn't changed as each of the beats 114 has been moved the same amount. To accurately track the BPM of the music piece, however, the detector device 14 also must change the tempo of the music piece that results from the change in location of beats 114 as directed by the sound impacts. The detector device 14 effectuates a corresponding shift in tempo in the same relative direction as the sound impact 70 fell relative to the initial beat 104 and subsequent beat 106. The detector device 14 makes this shift in addition to the changes dictated by the beat-shift region 118 as previously described.

In the preferred embodiment, the tempo is not shifted to the full amount represented by the sound impact 70, but is only shifted roughly 20% of that amount so that the detector device 14 can gradually implement changes in the tempo to see whether the sound impacts 70 are accurately detecting a change in the BPM. For example, assume that an initial tempo 117 is 500 ms, and the location of the subsequent beat 106 would dictate a new tempo 119 of 510 ms. In the preferred embodiment, the detector device 14, however, does not position all the subsequent beats 510 ms apart, but instead shifts a next off-beat 112 by only 2 ms 10% of the change and shifts the third beat 113 by a second 10% shift so that the tempo shift of the third beat 113 would represent 20% of the total tempo change dictated by the sound impact 70 following the subsequent beat 106. In this example, the off-beat 108 is then shifted from $t=t_0$ to $t=t_{B1}$ (the shifted dictated by the sound impact 70 surrounding the subsequent beat 106)$+t_{t1}$ (the shift dictated by the new tempo 119 presented by the same sound impact). Further, the third beat 113 is shifted from $t=t_0$ to $t=t_{B1}+t_{T1}+t_{S2}+t_{T2}$. In this manner, the tempo increases or decreases linearly to reflect changes in the underlying tempo and, as such, minimizes changes in the underlying tempo owing to random sound impacts 70 that are not representative of a real change in tempo.

Figure 4B:
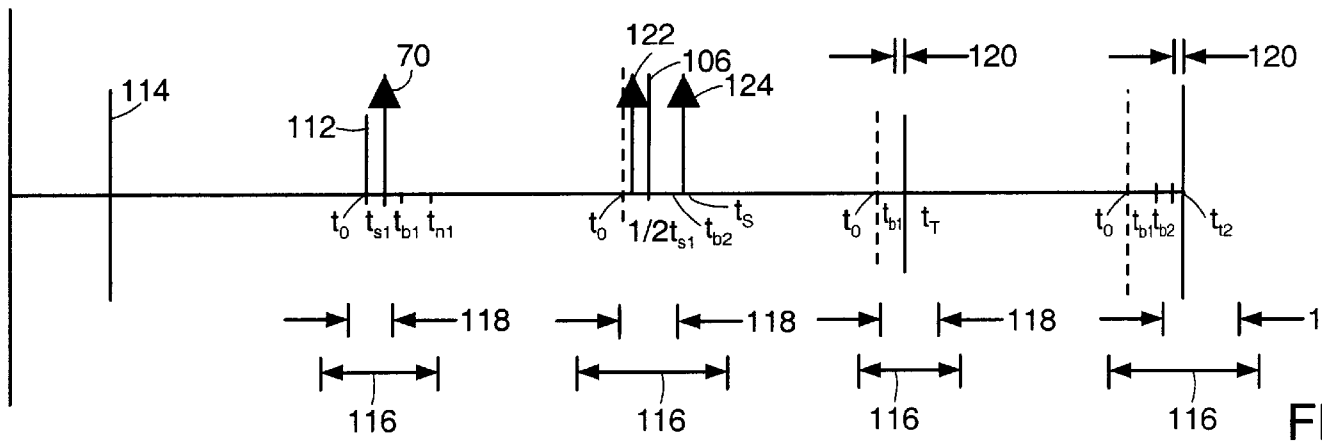
FIG. 4B is a graphical illustration of how the audio peripheral device of FIG. 1 tracks off-beats of the audio signal.

Off-beats 112 are treated slightly differently than beats 114, as is shown on FIG. 4B. The first difference is that the beat-shift region 118 does not change from a fast tracking-range to a slow tracking-range. The beat-shift region 118 surrounding off-beats remains the same and is symmetrically disposed about each of the off-beats 112. In addition, any beat shift necessitated by a sound impact 70 that falls within the near region 116 of the off-beats 112 is only shifted half of the distance of the sound impact 70 from the off-beat. For example, the sound impact 70 that falls at $t=t_{S1}$ within the near region 116 and within the beat-shift region 118 of the off-beat 112 results in shifting the subsequent beat 106 from $t_0$ to one-half of $t_{S1}$. Thus, the subsequent beat is shifted from $t=t_0$ to $t=\frac{1}{2}t_{S1}$. It should be evident that this modified treatment for off-beats 112 is to de-emphasize the effect of off-beats. However, it is possible to treat off-beats 112 as beats 114 or employ any amount of the emphasis for the off-beats 112 without departing from the scope of this invention.

FIG. 4B also illustrates the treatment of syncopated beats 122, 124. Syncopated beats are instances where two sound impacts 70 fall within the near region 116 of a beat. By their spacing, such closely positioned sound impacts 70 are usually a syncopation followed by a rhythm defying sound impact 70. As a result, the detector device 14 ignores the first syncopated beat 122 and utilizes only the second syncopated beat 124 which defines the rhythm to shift the underlying beats and tempo as previously described. Although not illustrated, it should be apparent that sound impacts 70 can fall on either side of the beats 114 and the next beats will be adjusted in the same relative direction as the positioning of the sound impact 70 in any of the manners described above.

Once the detector device 14 has found the BPM of the music piece and is tracking the beats, the detector device 14 displays the BPM on the BPM display 30 and flashes the beat LED 42 and the sound impact LED 44 to the music piece. At this point, the user can manually instruct the peripheral system 10 that the BPM and the positioning of the beats is correct by pressing a sync lock button 34 on the display interface 24. The user can also inform the peripheral system 10 that the positioning is correct by enabling other mixing features, as herein after described, such as pressing the beat assist button 38 twice in series, thus setting the BPM and the time position of beats 114. The peripheral system 10 can also be implemented to automatically enter sync lock mode after it has established the BPM, and allow the user to disable the same by toggling the sync lock button 34.

Further, the detector device 14 defaults to designating the beat at a time of engagement of the sync lock button 34 or the beat assist button 38 to be a down-beat of the music piece.

When the peripheral system is in sync lock mode, the detector device 14 assumes that the BPM of the music piece is limited to a small region, which in the preferred embodiment is plus or minus eleven and half percent (±11.5%) away from the BPM of the music piece upon entering of the sync lock mode. Thereafter, the BPM can be updated every four beats or less to provide rapid feedback of tempo changes. This is possible as the detector device 14 has a more limited range of BPMs to examine. This also insures that even if the rhythm pattern becomes complex or a few beats are missing that the beat detector will continue to track the tempo and align it with the beats of the music. Further, it allows the detector device 14 to adjust the BPM due to changes in a turntable or a CD being slowed down or sped up. It also can track changes that occur within the music piece itself, where these changes for most music usually fall within the plus or minus seven and half percent (±7.5%). It should be apparent that the percentage as well as the time periods between updates can be altered without departing from the scope of this invention.

Not only does the peripheral system 10 determine and display the BPM of a music piece and the location of the beats of the music piece, the peripheral system 10 also allows the user to augment, correct, or modify the functioning of the peripheral system 10 or the timing or location of the beats through manually enabling a beat capture mode, a beat assist mode or a tempo assist mode.

The beat capture mode allows the user to restart the music piece while informing the peripheral system 10 that the BPM of the music piece will remain the same as the user stops and restarts the music pieces. Such an application is used primarily to eliminate the need for recueing the device upon restarting the music When the user places the peripheral system into sync lock, the peripheral system 10 is informed, among other things, that it should enter the beat capture mode if the audio source 12 stops sending the audio signal 18. In the preferred embodiment, there is a 2.5 second delay prior to the peripheral system 10 enabling the beat capture mode after the audio source 12 discontinues sending the audio signal 18. This 2.5 second delay is chosen to prevent the beat capture mode from occurring during short breaks in the music piece. It is also chosen so that the beat capture mode will not remain disabled too long to miss the users halting of the audio signal 18.

In the beat capture mode, the peripheral system 10 already has the BPM of the music piece. Accordingly, it operates using an abbreviated method to track the beats. The beat capture mode is illustrated on FIGS. 5A and 5B.

Figure 5A:
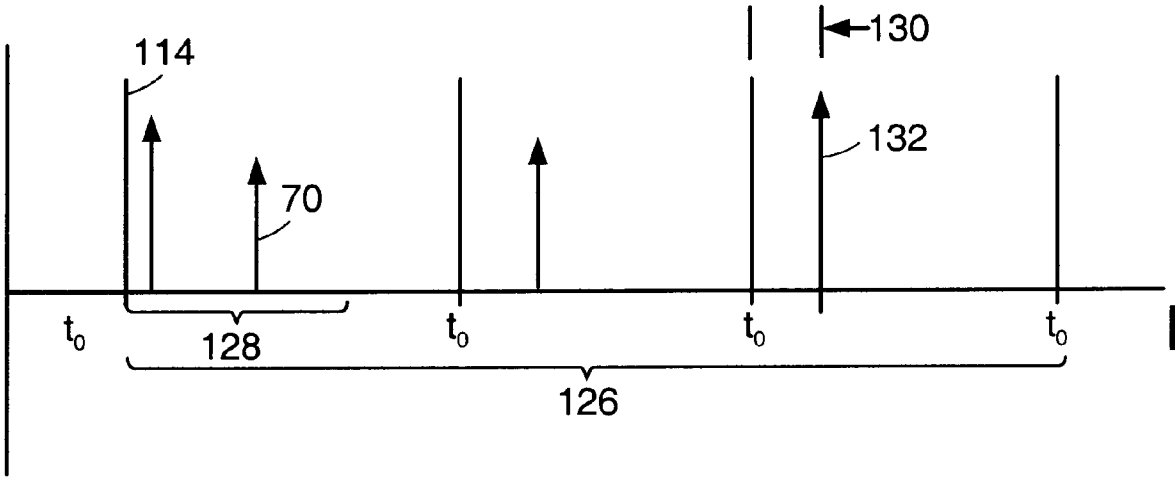
FIG. 5A is a graphical illustration of how the audio peripheral device analyzes an audio signal in beat capture mode.
Figure 5B:
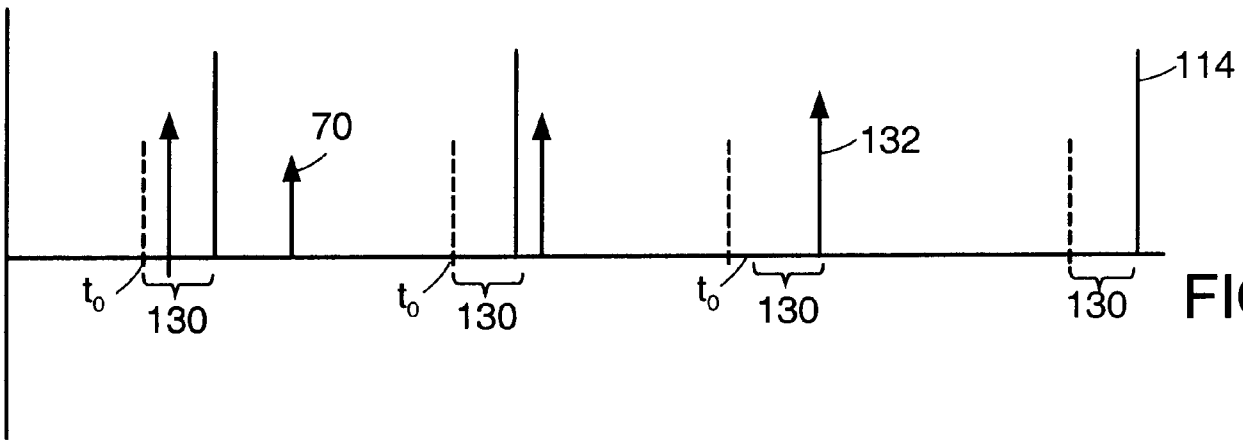
FIG. 5B is a graphical illustration of the beat capture mode of the peripheral device.

FIG. 5A shows the positioning of the beats 114 where the peripheral system 10 would have positioned them if the music piece had never stopped playing designated as $t=t_0$. It also shows the sound impacts 70 of the audio signal 18 after the restart of the music piece. As the detector device 14 already has the BPM of the music piece, the detector device 14 only searches over a truncated interval 126, being approximately one and one-half beats after the music piece restarts. It also, however, ignores a short time interval 128 initially after the sound starts to nullify the effect of any sound impact 70 that may be owing to a record needle dropping rather than a sound impact 70 of the music piece.

Further, the detector device 14 only searches for a sound impact having the greatest magnitude 132 within the truncated interval 126. The sound impact having the greatest magnitude 132 defines a first beat of the music piece. The peripheral system 10 then shifts all beats 114 and off-beats 112 by a shift amount 130 that corresponds to the relative displacement of the sound impact having the greatest magnitude 132 from an initial position of the beats 114 represented by $t=t_0$. The detector device 14 will thereafter alter the flashing of the beat LED 42 of display interface 24 to correspond to the shifted beats. Note that the truncated intervals 126 may be shortened to zero or to a fraction of the tempo interval 117. This may be more desirable for CD player based systems in which the music startup is clean.

Figure 6A:
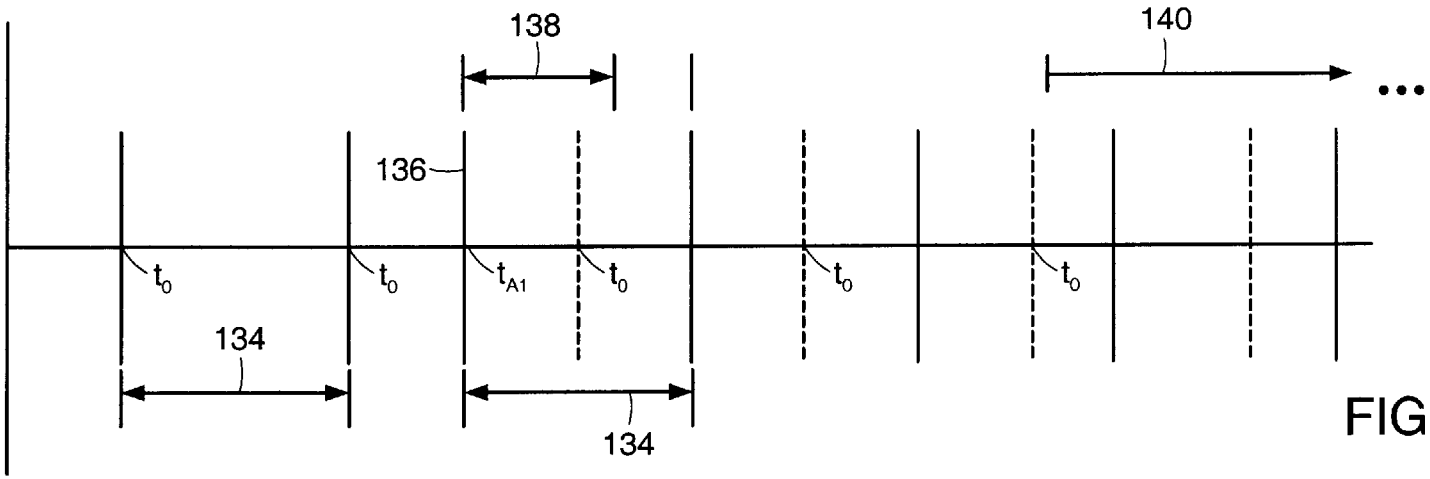
FIG. 6A is a graphical illustration of a beat assist feature of the audio peripheral device.

Turning now to the beat assist feature, which is graphically illustrated by FIG. 6A. FIG. 6A shows the positioning of the beats 114 where the detector device 14 would have positioned them if the beat assist button 38 was not engaged, initial positions are designated as $t=t_0$. When the user enables the beat assist button 38 the user is telling the peripheral system 10 that the initial positions of the beats 114 as displayed by the beat LED 42 are incorrect and the beats 114 should be repositioned according to the user's input.

For example, if the user enables 136 the beat assist button 38 at time $t=t_{A1}$, user is telling the peripheral system 10 that the beats should be realigned such that one of the beats 114 is positioned at time $t=t_{A1}$. The detector device 14 repositions the remaining beats 114 from the time $t=t_{A1}$ forward using the original tempo 134 to conform to the input of the user. The user can verify that the alignment of the beats 114 is correct by watching the beat LED 42. In this way, the user can manually change and check the location of the beats 114.

In the preferred embodiment, repeated engagement of the beat assist button 38 is ignored during a noncollection interval 138, to compensate for the user pressing the beat assist button 38 more than once by mistake. It should be evident that the noncollection interval 138 can be increased or decreased without departing from the scope of this invention, however in the preferred embodiment the noncollection interval is approximately 0.3 seconds.

Not only can the user modify the positioning of the beats using the beat assist button 38, the user can also modify the tempo by hitting the beat assist button 38 more than once. Each engagement of the beat assist button 38 indicates the proper positioning of the beat. The two positions corresponding to each engagement of the beat assist button 38 defines the tempo chosen by the user and thus the BPM of the music piece.

Figure 6B:
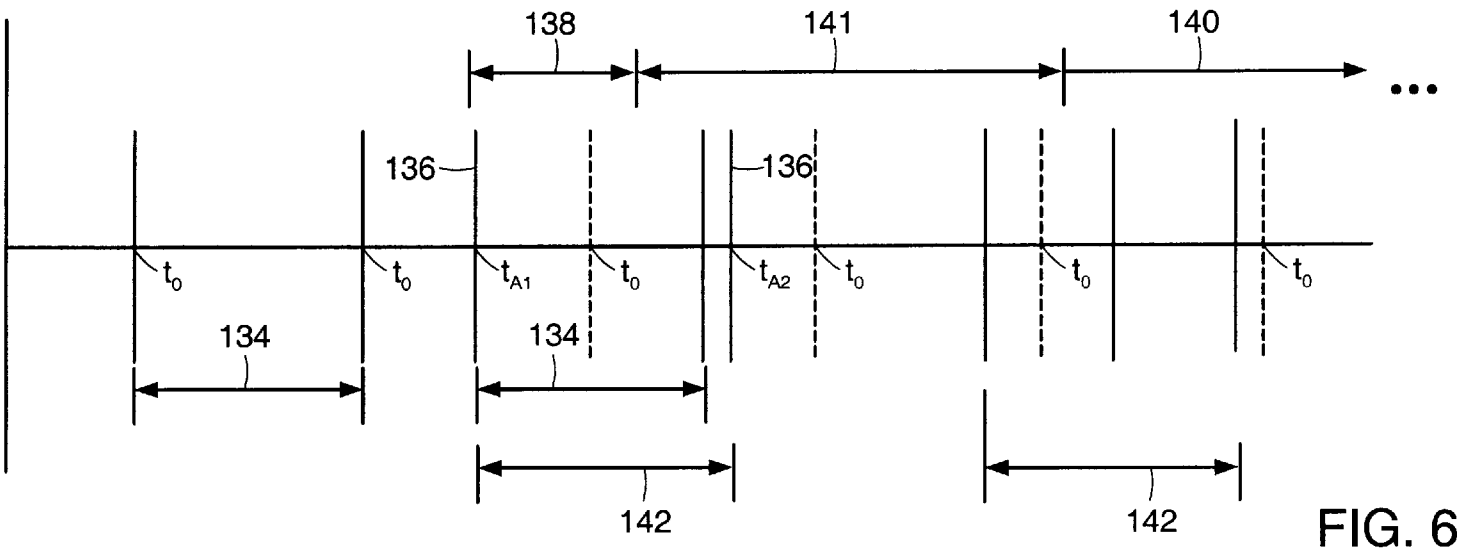
FIG. 6B is a graphical illustration of a tempo assist feature of the audio peripheral device.

FIG. 6B illustrates the beat assist feature and the tempo assist feature working in combination, where like numerals designate like elements. If the beat assist button 38 is engaged once at 136 the beats 114 are shifted but the tempo is not modified. However, if the beat assist button 38 is engaged 136 one more time during a tempo modify interval 141, then the tempo of the music piece is also modified. The tempo of the music piece will thus be changed from the original tempo 134 to a new tempo 142 corresponding to the time interval between the two engagements 136 of the beat assist button 38.

In the preferred embodiment, in the event that the beat assist button 38 is pressed multiple times within the tempo modify interval 141, the new tempo 142 becomes the average time spacing between the last 2–8 taps of the beat assist button 38. It should be apparent that this averaging accommodates the user tapping the beat assist button multiple times while not effecting the performance of the peripheral system 10.

The duration of the tempo modify interval 141 allows the BPM of the music to be adjusted to the extreme ends of the user's choice of BPM ranges. For example, if the user chose the BPM of the music piece being tested to be between 50 BPM and 200 BPM the tempo modify interval 141 at its extreme point will represent 200 BPM while at its initial starting point will represent 50 BPM. The ends of this range correspond to 199 BPM and 50 BPM in the preferred embodiment.

If the beat assist button 38 is pressed outside of the tempo modify interval, the peripheral system 10 will interpret this as just a beat assist button 38 not a tempo assist request and simply shift the beats while maintaining the same tempo.

Turning now to the preferred embodiment, in the preferred embodiment the detector device 14 is integrated into a dual port CD player. An advantage of integrating the detector device 14 with the CD player is that a detector device 14 can read the digital output of the CD player or the analog output of the CD player and use such information to enhance the function of the detector device 14. For example, the detector device 14 predicts the location of beats of the audio signal 18 by reading the disc speed off the CD player prior to transmission of the audio signal 18 and determining how much the CD player is speeding up or slowing down at any given time.

An alternative method of integration is to simply connect the detector device 14 to an audio output of the CD player.

In the preferred embodiment, a recorded music piece is used and the signal from the CD player is over sampled at 2.5 kHz such so that tempo changes can be accurately computed by the detector device 14 prior to the playing of the beats of the music piece. The location of the predicted beats 114 are shifted by an amount inversely proportional to a change in speed integrated over time. So if the CD player speed increases by 10%, the distance between beats is predicted to be roughly 10% smaller. As a result, the sound impacts 70 are more likely to land exactly on the beats.

Figure 7A:
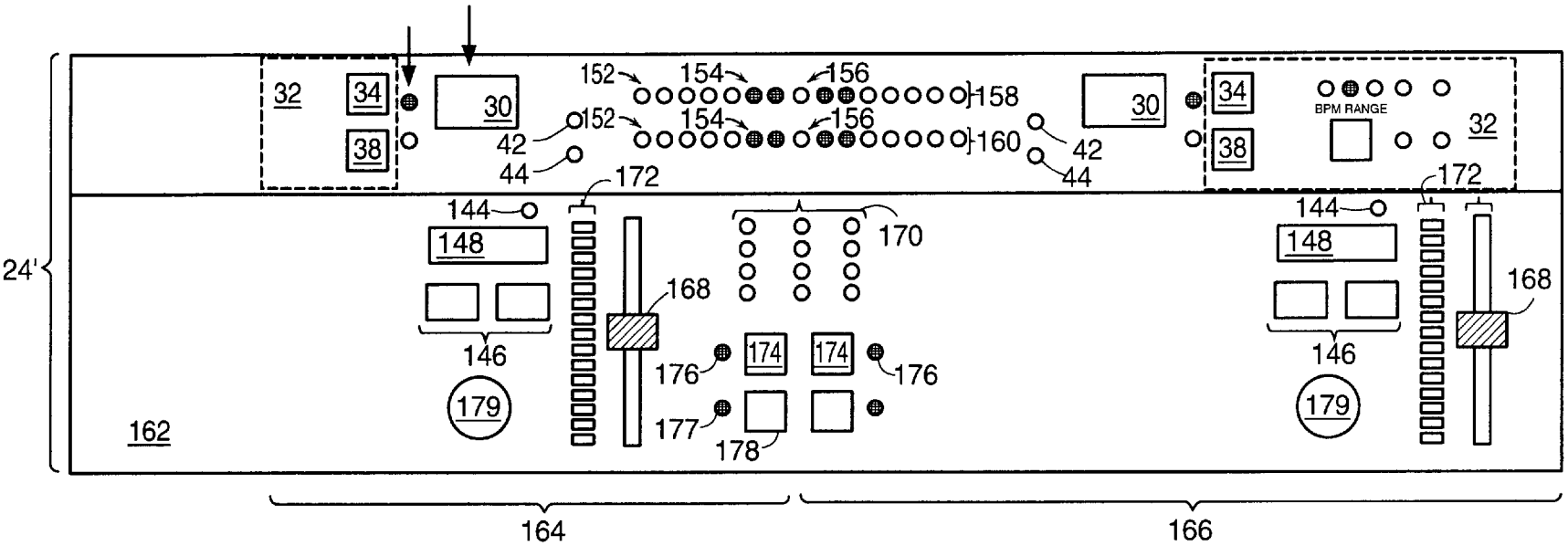
FIG. 7A is a schematic view of a display interface of the peripheral device integrated with a dual CD player in accordance with one embodiment of this invention.
Figure 7B:
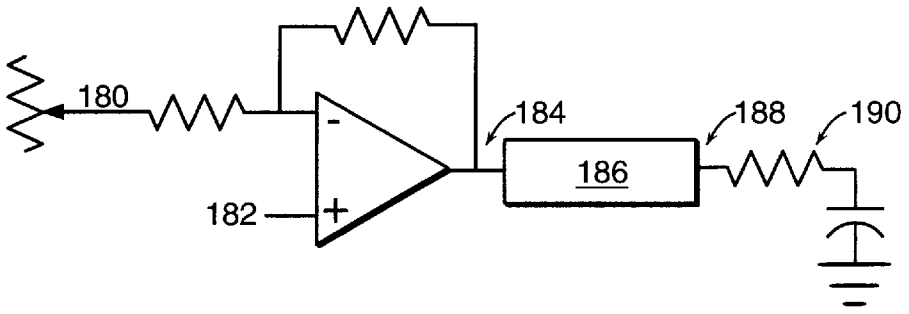
FIG. 7B is a schematic diagram of a feed-forward device used by the audio peripheral device to ascertain beats of the audio source when the audio source is a digital audio source.

Although this may be implemented using a digital communications link between a CD player control chip and the processor 16, it can also be implemented using the circuit diagram as shown in FIG. 7B. The disc speed signal 180 from the CD player, where the disc speed signal 180 can for example be output of a pitch control such as pitch control 168, is compared to a pitch control signal 182 from the detector device 14 when the detector device 14 enters sync lock mode. The difference 184 between the disc speed signal 180 and the value of the pitch control signal 182 from the detector device is input into a processor 186, which scales and shifts the difference 184 to convert the difference to a tempo change command 188. The tempo change command 188 is then filtered such that the output 190 represents the response of the CD player to the change in tempo required by the tempo change command 188. The output 190 is integrated to find positions of the beats and the off-beats. In the preferred embodiment, the tempo change command 188 is filtered with a single-pole filter having a 0.3 second time constant. The 0.3 second time constant is used since the CD player responds exponentially to changes in commanded speed with roughly a 0.3 second time constant. The filter used depends on the design of the CD player, where a different filter would be used for a CD player set to a response of 0.1% per 20 ms.

This positioning of the beats and off-beats is used in conjunction with the before described beat tracking method. However, as the detector device 14 has supplemental information regarding positioning of the beats, the detector device 14 does not have to shift between the slow beat-shift region default and the fast-tracking beat shift region as was described with reference to FIG. 4. Thus, by reading the CD player's response to changes in tempo of the music piece, the detector device 14 can more easily track the beats.

Turning now to FIG. 7A, where like numerals designate like elements, a second embodiment of the display interface 24' is shown as is used when the detector device 14 is integrated into the dual port CD having two channels 164, 166. The display interface 24' provides information for both of the channels 164, 166 such as the BPM display 30, the sound impact LED 44, the beat LED 42, and the control features 32, which function as previously described.

The display interface 24' also includes upon a CD interface a marching bar graph 170 that further enhances the usefulness of the display interface 24' for mixing purposes. One implementation of the marching bar graph 170 comprises three rows of four LEDs each, positioned vertically. Each side row represents one of the channels 164, 166 and a corresponding LED in the middle row illuminates when the beats of each of the channels 164, 166 coincide. In the preferred embodiment, the LEDs representing each channel 164, 166 are red LEDs, while the interactive nature of the channels 164, 166 are represented by green LEDs. Thus, the user is provided with a different intuitive beat-offset indicator which greatly assists in beat mixing.

The four LEDs represent the four timing signature common to most dance music that is mixed by DJs. As such, each LED corresponds to one beat of a measure of the music piece. The first of the four LEDs for each channel preferably corresponds to the down-beat of each measure and is denoted as the initial position, which can be set manually as previously described or automatically by the detector device 14. Each time the beat LED 42 flashes for one of the channels 164, 166 the portion of the marching bar graph 170 corresponding to the same channel activates a different LED. If the beat LED 42 for each of the channels 164, 166 flashes at the same time, then the LEDs across all three rows of the marching bar graph 170 will substantially simultaneously illuminate. It should be apparent that the marching bar graph 170 can also be used when integrating the detector device 14 with other peripherals, such as a sampler, for example.

An additional interaction between the channels 164, 166 is displayed on the display interface 24' as a tempo-difference graph 158 and a beat off-set graph 160. The tempo-difference graph 158 and the beat off-set graph 160 both comprise a plurality of LEDs positioned horizontally in the preferred embodiment across the display interface 24'. In the preferred embodiment, the tempo-difference graph 158 and the beat off-set graph 160 are activated after both of the channels 164, 166 enter sync lock mode, as this is when most users perform mixing, and as such can use the tempo-difference graph 158 and the beat off-set graph 160 of the interface display 24' to aid the mixing.

The tempo-difference graph 158 uses a plurality of colored LEDs to visually illustrate any relative differences between the tempos of the channels 164, 166. A green LED 156 is centered in the horizontal row of the plurality of LEDs. When the green LED 156 is activated, it indicates that the BPM of channels 164, 166 are virtually the same to within plus or minus two (±2) BPM. The green LED 156, as such encompasses a four BPM range.

Surrounding the green LED 156 are four yellow LEDs 154 having two LEDs disposed with on each side. When any of the four yellow LEDs 154 are activated, they indicate that the tempos of the channels 164, 166 are fairly close together and as such that if the beats are aligned they should stay aligned for at least a few beats. The remaining ten LEDs of the tempo-difference graph 158 are red LEDs 152, where five LEDs are disposed on the terminating ends of the tempo-difference graph 158. When any of the red LEDs 152 are activated, the red LEDs 152 indicate that the tempos of the channels 164, 166 are so far off that even if the beats are aligned, the beats will rapidly become unaligned. Each of the red LEDs 152 and the yellow LEDs 154 represent a 2 BPM change from one LED to the next. As such if the 2nd yellow LED 154 is illuminted the BPM of the channels would be off by plus or minus 6. In the preferred embodiment, when the LEDs are illuminated to the right of a center of the tempo-difference graph 158, the BPM of channel 166 is greater than that of channel 164 and vise versa.

The beat off-set graph 160 is also comprised of a plurality of colored LEDs. The beat off-set graph 160 indicates the time difference between the positioning of beats of the channels 164, 166. Again, a green LED 156 is centered in the horizontal row of the beat off-set graph 160, and the illumination of the green LED 156 indicates that the beats of the channels 164, 166 are synchronized. The green LED 156 encompasses plus or minus 15 ms range in the preferred embodiment.

Surrounding the green LED 156 are again four yellow LEDs 154 positioned with two on each side of the green LED 156. The yellow LEDs 154 when activated indicate that the beats from the channels 164, 166 are very close to being synchronized so that the time difference between the beats is barely audible. Again, ten red LEDs 152 in groups of five each are positioned at the terminating ends of the beat off-set graph 160 and indicate that the beats of channels 164, 166 are separated in time such that the distinction is audible.

In the preferred embodiment, the difference between each of the red LEDs 152 and the yellow LEDs 154 is 15 milliseconds.

The tempo-difference graph 158 and the beat off-set graph 160 are updated when one or both of the BPM displays 30 are updated. In the preferred embodiment, the detector device 14 also updates the tempo-difference graph 158 and the beat off-set graph 160 after every four beats of the music piece having a higher BPM, and thus averages changes during the four beats. In this way, the tempo-difference graph 158 and the beat off-set graph 160 will be repositioned every measure without causing any distracting jumping of the LEDs caused by activating and deactivating the LEDs.

In an alternative embodiment, the beat off-set graph 160 is averaged over four beats only when the green LED 156 or the yellow LEDs 154 are activated. In contrast, it is updated on every beat while the red LEDs 152 are activated so that the user can more quickly synchronize the channels 164, 166. It should be apparent that the averaging of the beat off-set graph 160, its configuration, and the relative difference in time between the LEDs can be altered without departing from the scope of this invention, including for example, displaying the beat off-set graph 160 on a computer display.

The beat off-set graph 160 can also display a relative displacement of the beats of one of the channels 164, 166 to the off-beats off the other channel. In one implementation, the beat off-set graph 160 defaults to display the difference between the beats and the off-beats. It does this when the beats and the off-beats are closer than the beats of the two channels 164, 166 or if the user manually instructs such a display by engaging a control button, for example. This display is particularly relevant when mixing slower dance music, such as rap. The display device can be adapted to indicate that it is displaying the difference between the off-beats and the beats.

Turning now to pitch control of the music piece, using the display interface 24' the user can control the pitch of each of the channels 164, 166. The peripheral system 10 defaults to displaying a nominal value of the pitch on a bar graph 172, where the nominal value can be zero to indicate that there is no change in pitch or a tolerance range such as plus or minus 8% or 16%, for example. If, however, the user engages a pitch control button 148, a pitch LED 144 will illuminate and the pitch of the music will be displayed on a bar graph 172. The pitch so displayed corresponds to the pitch associated with the BPM chosen by the detector device and output to the CD player. In this mode, the pitch on the bar graph 172 and the pitch of the CD player as directed by the pitch control 168 will be the same.

While the pitch control button 148 is activated, the user can direct the pitch of the music piece to a value dictated by the pitch control 168 or a value within the pitch bend range 146. First, the user can change the pitch by moving the pitch control 168. Thus, forcing the CD player to change the pitch of the music piece. The change in pitch will be displayed upon the bar graph 172.

In addition, the user can also temporality shift the beat by pushing one of the pitch bend buttons 146. Pressing the pitch bend buttons 146 will temporality change the tempo while the pitch bend buttons are depressed. When the pitch bend buttons 146 are released, the tempo returns to the tempo dictated by a the pitch control 168 as long as the pitch LED 144 is illuminated.

The user can also have the detector device change the pitch for a "beat-to beat" mix, as hereinafter described.

An advantage of having the detector device 14 integrated with the CD player is that the detector device 14 allows the channels 164, 166 of the dual port CD player to be interactive. When the channels 164, 166 are interactive, the user can mix the two channels 164, 166 in manners such as the "beat-to-beat" mix or "slam" mix, for example. A "beat-to-beat" mix is where one sound source is overlaid over another having the beats of both sound sources match for several seconds and then having one of the sound sources gradually fade into the other sound source. A "slam" mix is where one music source is suddenly stopped and the other is started so that the beat flow is not interrupted.

To perform the "beat to beat" mix the tempos of the channels 164, 166 are aligned by changing the pitch of at least one of the music pieces. To perform the "beat-to-beat" mix the user activates a beat-to-beat button 174, which will illuminate a beat-to-beat LED 176. In this mode, the bar graph 172 reflects the pitch dictated by the detector device 14 and not the output of the CD player. When the beats of the channels 164, 166 are matched, the display interface 24' will flash both of the beat LEDs 42 in synchronization, and the green LEDs 156 of the tempo-difference graph 158 and the beat-offset graph 160 will be illuminated.

Figure 8A:
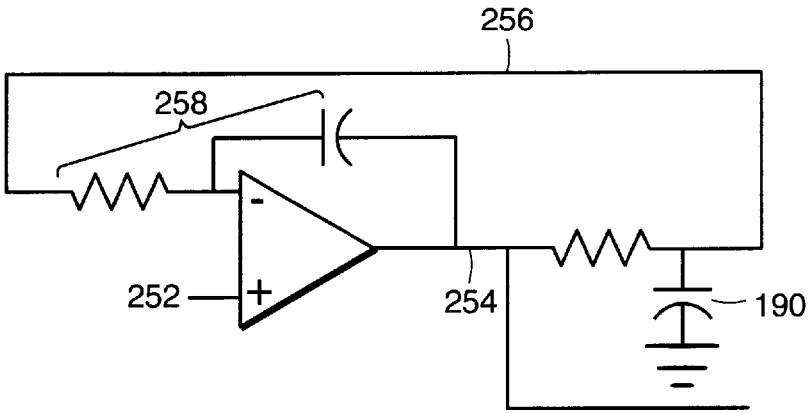
FIG. 8A is a schematic diagram of a tempo adjust feature of the audio peripheral device in a beat-lock mode.
Figure 8B:
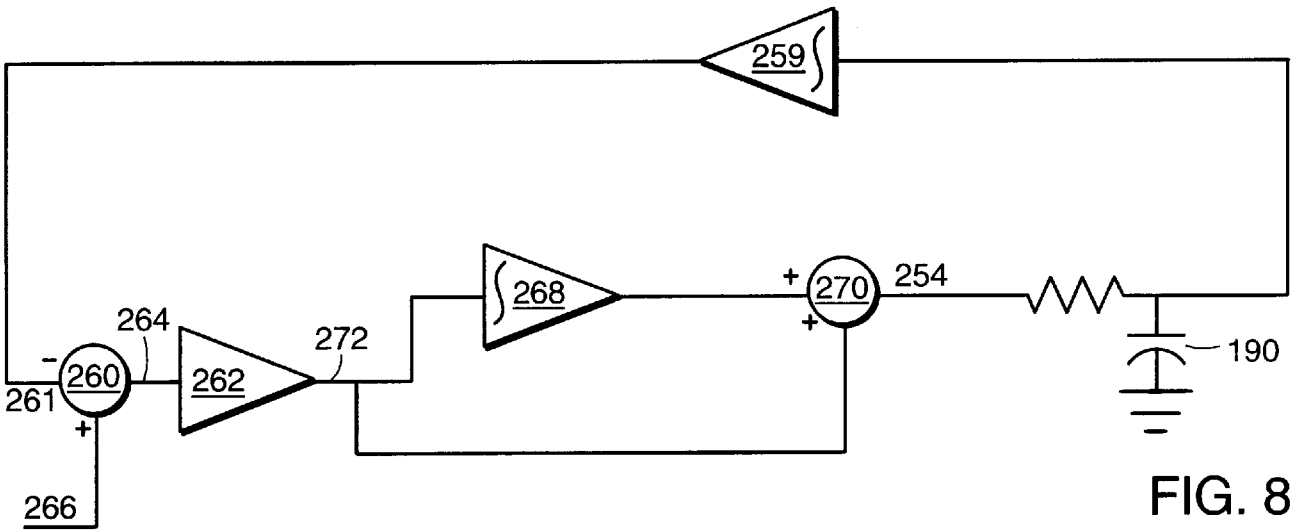
FIG. 8B is a schematic diagram of a beat-shift and tempo adjust feature of the audio peripheral device in a beat-lock mode.

After each of the channels 164, 166 are placed in synclock mode, the beats of channels 164, 166 are matched by first matching tempos, then shifting the beats until they are aligned, and then making any farther adjustments to the tempo so that the BPMs of the channels 164, 166 are identical. This is done in the preferred embodiment as illustrated on FIGS. 8A and 8B. The initial tempo matching is simply a phased lock loop as illustrated in FIG. 8A. The signal 256 represents the tempo of the channel to be altered from the detector device 14, while the signal 252 represents the tempo from the detector device 14 of the channel with which the other tempo will be conformed. An integrator 258 zeros out any error between the tempos, and the signal 254 represents the tempo control signal from the detector device 14 that is input into the CD player. In the preferred embodiment, the integrator 258 has a response time of approximately six beats to allow the CD player time to respond to the tempo change if the response time is much faster then the tempo control signal provided by the detector device 14 and will oscillate up and down since the negative feedback designed to control the tempo will become positive feedback. After being filtered, a signal 190 represents the response of the CD player speed to the tempo control signal 254 that instructs the CD player to change the tempo of the channel to be altered to match the tempo of the channel to which both channels are being conformed.

Once an approximate response of the CD player 190 is known the beats of the channel to be altered are shifted to coincide with the beats of the other channel. Inputting the tempo control signal 254 and the response of the CD player 190 results in a change in tempo in the channel to be altered. Using small signal analysis, the response of the CD player 190 is converted to a change in relative beat time by integrator 259. This relative beat signal 261 is subtracted 260 from the relative beat 266 of the fixed channel, thus resulting in a beat offset signal 264. The beat off-set signal 264 is simply the beat off-set between the channel to be altered and the channel to which both channels are being conformed. The beat off-set signal 264 has to be scaled and has to pass through scaler 262 so as to appropriately match the BPM of the two channels. Without going any further the scaled results of the beat off-set signal 264 is the equivalent of the pitch and bend features of the CD player integration embodiment, and will result in shifting the beats.

The beats, however, will never be perfectly aligned if the tempos are slightly off. In such a circumstance, there will be a constant beat off-set as represented by the constant beat off-set signal 266. To fix this problem, an inverted integrator 268 integrates the scaled beat off-set signal 272 and adds the integrated signal to the scaled beat off-set signal 272 via an adder 270 to shift the beats in the correct direction without a beat off-set. As such, the tempo of the channel to be altered and the tempo of the channel to which both channels are being conformed, as well as their beats will be aligned.

In the preferred embodiment, to avoid sudden tempo changes once the beat-to-beat mode is deactivated, the pitch LED 144 is flickered on and off as a warning using one of the control signals. This process is performed automatically by a switching circuit electrically connected to the processor 16. It should also be apparent that this process can be performed in software as well as in hardware or using other methods well known in the art. The flickering informs the user to match the pitch control 168 to the bar graph 172.

The signals thus produced can also be manipulated by the processor 16 prior to playing if adequate sound buffering is provided in the CD or from the storage device 22 of FIG. 1. As such, the actual sound output can have the tempo and beats perfectly matched instantaneously by storing the positioning of beats of the channel to which the tempo is conformed, and shifting the beats in the storage device 22 of the channel to be altered for the same interval. Thereafter, the shifted interval can then be played while concurrently a second interval is being shifted and stored in the storage device 22 coupled to the processor 16.

The peripheral system 10 also enables the user to perform the "slam" mix previously described by activating the auto play/pause buttons 178 for either of the channels 164, 166. The peripheral system 10 will instruct the CD player to pause just before the downbeat either by electronically 'shorting' the button or sending a "pause" command to the CD player processor. The pause LED 179 will illuminate just after pressing the auto play/pause button 178 and turn off immediately after the CD player automatically pauses.

When auto play/pause button 178 is enabled a pause LED 179 will illuminate and the detector device 14 electronically pauses the channel by sending a control signal to the processor 16 that shorts out the play button contacts. At this point, the paused channel is ready to start on a down-beat of a measure. It can be used to create a "slam" mix as previously described or as a pause feature. The pause LED 179 is deactivated, but the user can begin playing the channel on the down-beat of a measure by toggling a play-pause button 178.

Although the auto play/pause buttons 178 can be used in other embodiments, in the CD player integration a synchronized play/pause can also be performed which will allow the user to pause and then to start both songs on the same beat, which will be matched as the down-beat of the measure. This is an additional way to match the beats of the song on a down-beat of a first measure.

In this implementation, in the event that both channels are not playing when the synchronized play/pause is activated, the detector device 14 immediately pauses the second channel, and as such assumes that the second channel is already initiated to begin playing upon a down-beat.

Figure 9:
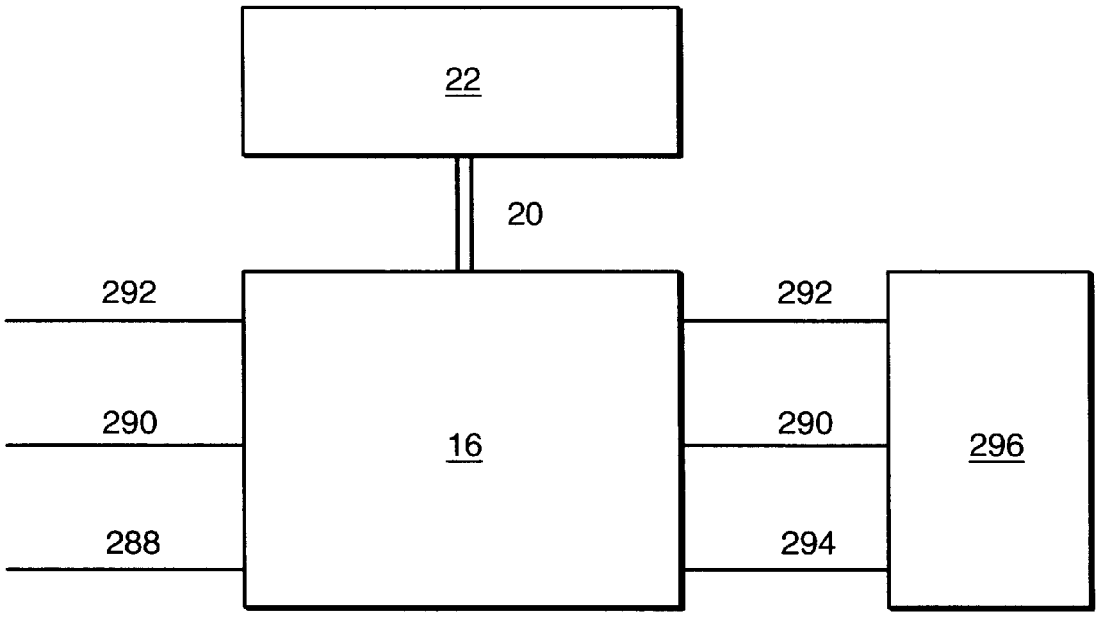
FIG. 9 is a box diagram of an audio peripheral device in accordance with another embodiment of this invention.

FIG. 9 shows an alternative embodiment of the detector device 14 coupled to dual channel CD player. As is shown the processor 16 is coupled to a storage device 22 by a interface 20. In this embodiment, the processor 16 is adapted to receive serial input 288 from the CD player as is clocked by the clock signal 290. In this embodiment the input 288 as well as the output 294 is clocked by the clock signal 290. There is also a frame sync signal 292 received from the CD player into the processor 16 to inform the processor 16 when a new group of data will be input into the processor 16. The processor 16 performs functions as described herein and outputs 294 serially to a digital to analog converter 296 using the clock 290 and the frame signal 292. The clock and the frame sync signal operate at 88.2 kHz in the preferred embodiment resulting in a net 44.1 kHz sampling rate for both left and right channels. This rate is varied according to the speed of the CD player. The digital output 294 is then processed by the digital to analog converter 296 which is thereafter transmitted as is necessary either back to the speed control of the CD player or back to the processor 16.

Figure 10:
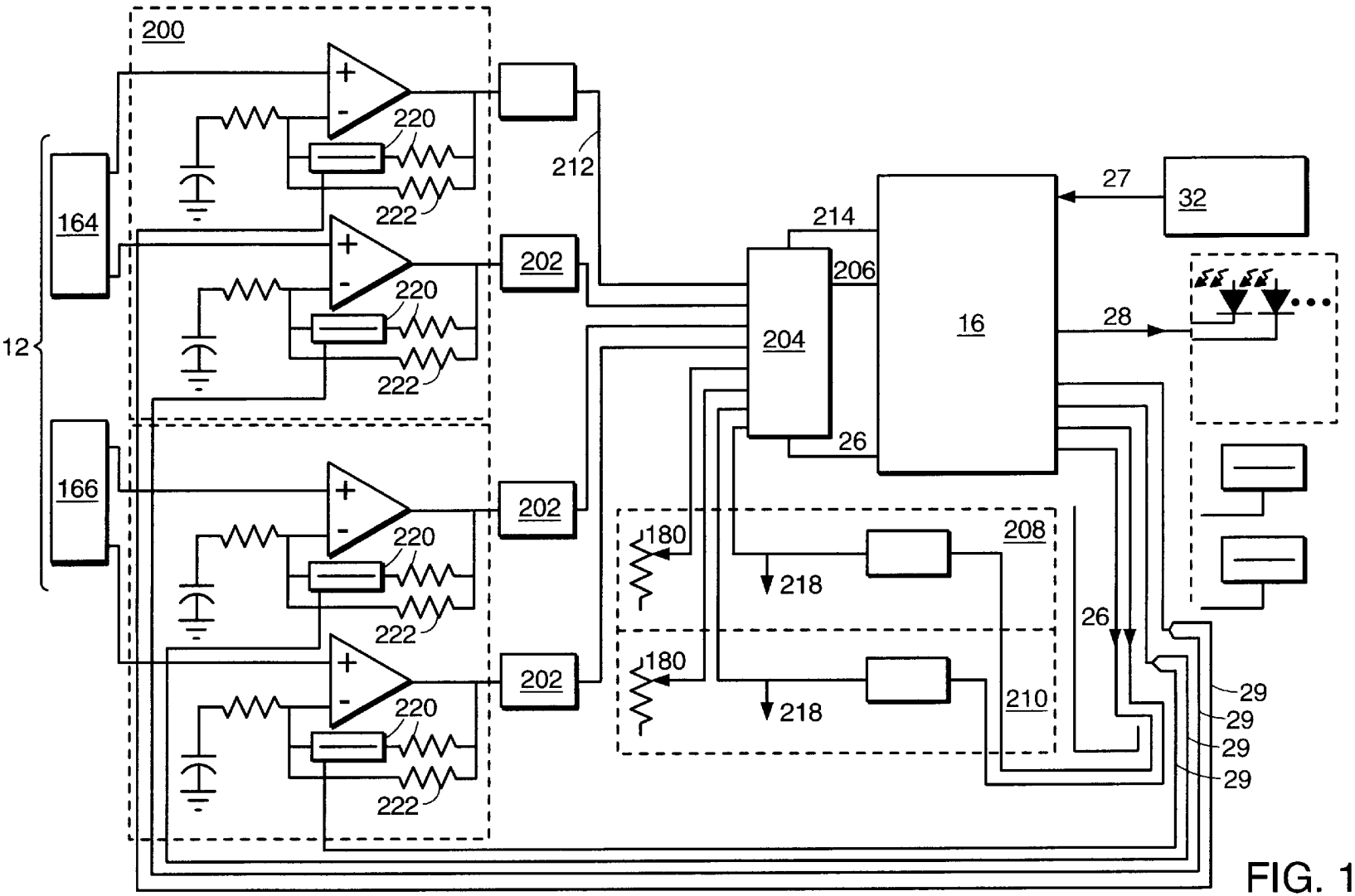
FIG. 10 is a schematic diagram of a generic two input audio peripheral device in accordance with one embodiment of this invention.

Although the preferred embodiment uses a two channel CD player integrated to the detector device 14, any two audio sources can be input into the detector device 14 as is shown in a third embodiment on FIG. 10 which illustrates a generic diagram of the detector device for more than one embodiment, where like numerals designate like numbers. As is shown, two audio sources 12 output a stereo audio signal 18 into one of the channels 164, 166 of the detector device 14. A left and right side of the channels 164, 166 is amplified via an amplifier 200. The audio signal 18 from the audio sources 12 can also be passed through a circuit that uses any combination of AC coupling capacitors and resistor-divider circuits to produce a proper DC level and optimize a signal level for inputting into an A/D converter.

The amplified signal is passed through a filter 202. The filter 202 in the preferred embodiment is a low-pass filter having a cut-off frequency of approximately middle C. This allows the detector device 14 to search only the lower frequencies for beats of the music piece The filter 202 cuts out frequencies above approximately 3 kHz in the preferred embodiment so as to require less processing power from the processor 16. However, other cut-off frequencies can be used or a switchable filter or a software implementation can be used to allow the detector device 14 to search for any frequency range as desired by a user.

The filtered signal 212 is input into an analog to digital ("A/D") converter 204, such as a national ADC08038 which samples at approximately 5 kHz for each input in the preferred embodiment. The A/D converter 204 digitizes the filtered output 212 and communicates the same to the processor 16 via the input signal 214 as clocked according to a clock 206. It should be apparent that when the audio sources 12 have digital outputs it is unnecessary to have the A/D converter.

The processor 16 can be any digital processor and can communicate with the A/D converter 204 serially, as shown, or in parallel. The clock signal clocks both the A/D converter 204 and the processor 16 in the preferred embodiment. Output from the processor 16 includes both control signals 28 and output signals 26, such as the digital representation of the audio signal 18 as processed by the processor 16, for example. The processor 16 is also adapted to receive digital inputs 27 from the control features of the display device such as sync lock mode.

In the preferred embodiment, a decoder conforms the output signals 26 and the control signals 28 to interface with a display interface 24' of a detector device 14 as well as the peripherals attached to the detector device 14 which can include the audio sources 12. The interface between the processor 16 and the decoder can be either a serial or parallel interface using clocks and bus interfaces as are necessary.

At least a portion of the control signals 28 illuminate the LEDs on the display interface 24. In the preferred embodiment, the control signals 28 to the LEDs are multiplexed to reduce the number of required signals to 2×SQRT (n), where n is the number of LEDs on the display interface 24. However, in the preferred embodiment some of the control signals 28 to the LEDs are non-multiplexed for the LEDs that require precision timing, such as the beat LED 42 and sound impact LED 44, for example.

The processor 16 also outputs control signals 28 to activate electronic switches in the preferred embodiment for gain selection on amplifiers and for activating functions in a peripheral or audio source, such as a CD player or sampler, for example. The control signals 28 can cause, for example, light activation, looping, writing samples, playing and pausing, and stuttering in these devices. The electronic switches are implemented using hardware such as the CD 4066, for example, or by using a software implementation as is well known in the art.

The detector device 14 is also adapted to receive signals 180 from the audio sources 12 such as speed control on a CD player or a sampler during sound source playback, for example. This enables the detector device 14 to implement features such as the prediction described earlier. The signals 180 from an audio source 12, such as speed control for example, is re-directed from the audio source 12 into the A/D converter 204. The signals 180 are replaced with analog signals 218 from the peripheral system 10. The analog signals 218 are generated by the output signals 26 from the processor 16. The output signals 26 are filtered using a 20 millisecond time constant in the preferred embodiment to convert a digital pause width modulation of the output signals 26 into analog signals 218. This filter is chosen to limit processor power while at the same time being much faster than the natural response of the CD player. The filtered digital outputs are sampled through the A/D converter 204 and provided back to the audio source 12 as analog signals 218. This process is conducted for both sides 208, 210 of each channel of an audio source 12 so connected. The feedback allows the processor 16 to adjust a duty cycle of the output signals 26 to make the analog signals 218 match any desired value. The overall function is effectively a low speed D/A converter. In an alternative embodiment, the signals 218 could be multiplied so as to control not only one audio source 12 but more than one, or they could be digital. As such, the audio sources 12 so controlled can be any combination such as two CD players or a CD player and three samplers, for example.

In the preferred embodiment in order to reduce the need for using a higher resolution A/D converter 204, the amplifier 200 employs a line level resistor 220 and a switchable phono level resistor 222 for each side of each channel of the audio signal 18. A line level signal is an electronic signal coming from the CD player, tape player, or amplified record player output for example, which is usually about 770 mV. As such, a switchable line level resistor 220 is used for low gain inputs. A phono level signal is an electronic signal coming directly from a record needle usually of only a few mV. As such, a switchable phono lever resistor 222 is used for high gain inputs.

Figure 11:
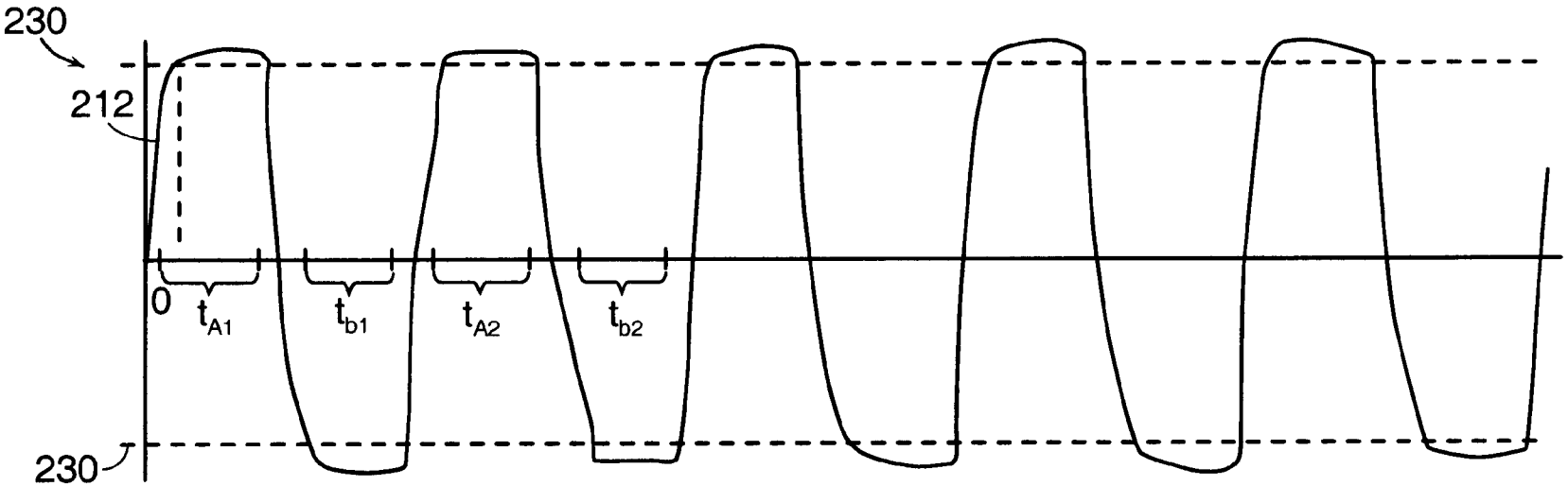
FIG. 11 is a graphical illustration of an audio input level controller of FIG. 10.

The default when the detector device 14 it turned on is that audio leveler control signals 29 outputted from the processor 16 are low. As the audio leveler control signals 29 are input into the amplifier 200, they cause the amplifier 200 to operate in high gain mode for phono level signals. As such, if the audio signal 18 is a line level signal, the amplifier 200 will saturate severely. In this implementation, the processor 16 looks for filtered signals 212 above and below a saturation threshold 230 as is illustrated in FIG. 11 which shows a filtered signal 212. The processor 16 sums the time intervals $t=t_A$ and $t=t_B$ during which the filtered signal 212 is above the saturation threshold or below the saturation threshold. In the preferred embodiment, if the sum exceeds approximately 10% of the signal, the audio leveler control signal 29 outputted from the processor 16 activates an electronic switch disposed in the amplifier 200 to allow the amplifier 200 to switch to the low gain mode by placing the low gain resistor 220 in parallel with the high gain resistor 222, thus resulting in an overall low gain. The use of the switchable amplifier allows the detector device 14 to work with a slightly larger ranges of audio signals 18 without requiring an increase in the resolution of the A/D converter 204 and, as such, an increase in price.

Figure 12:
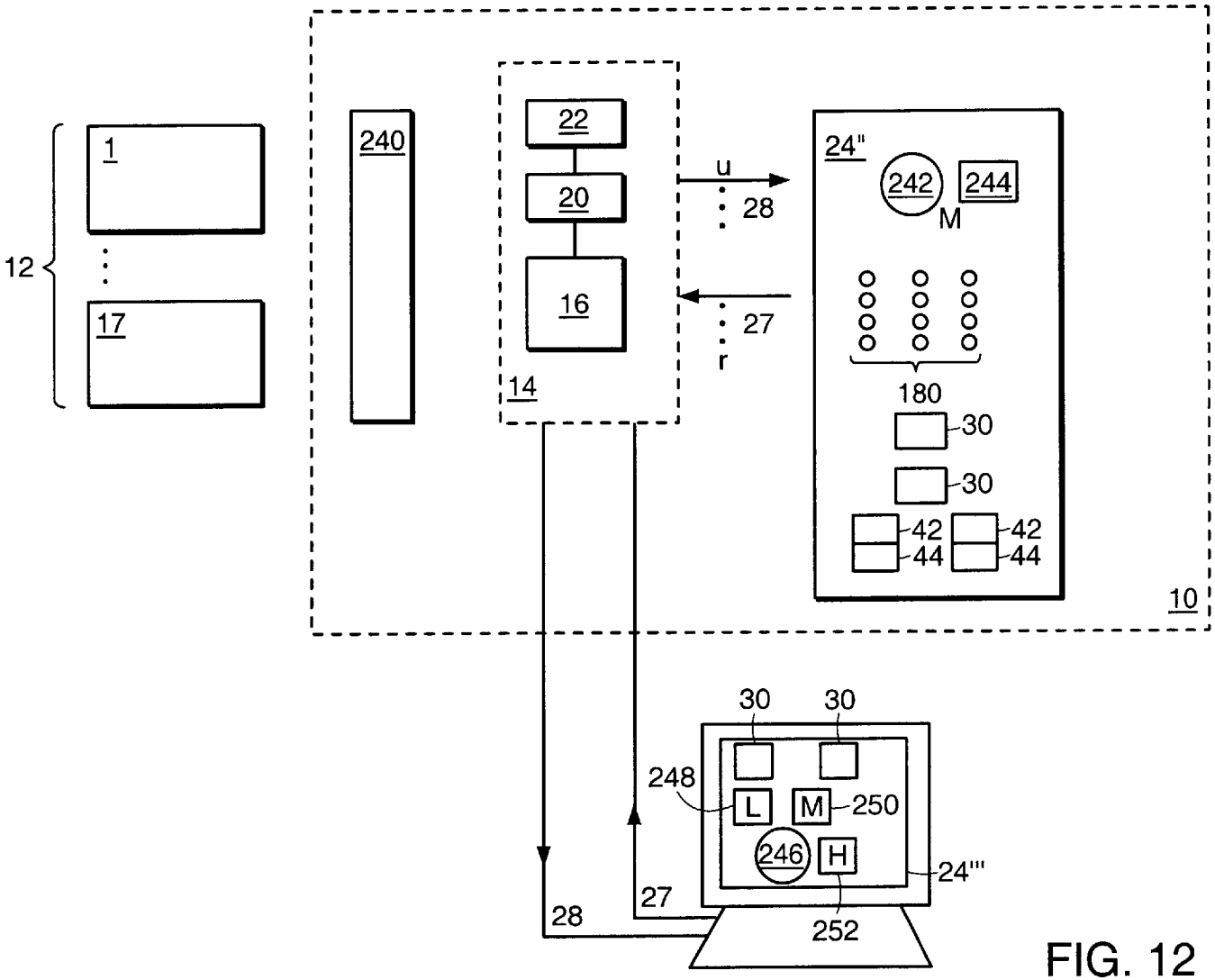
FIG. 12 is a schematic diagram of a multiple input audio peripheral device in accordance with another embodiment of this invention.

Turning now to FIG. 12 where a fourth embodiment of the detector device 14 is shown, where like numerals designate like elements. This detector device 14 is coupled to more than two possible audio sources 12 and more than one display interface 24", 24'". It should be apparent that the audio sources 12 can all be active and transmit audio signals 18 to the peripheral system 10, or the audio sources 12 can be electrically connected to the peripheral system 10 through a device that selects which of the audio sources 12 will be used. For example, an analog multiplexor which uses flexible switch inputs can be used to choose between which of the audio sources 12 are activated.

If more than two audio sources 12 are activated, the processor 16 will be adapted to transmit more digital outputs for control features such as the LEDs and receive more digital inputs from the display interfaces 24", 24'". The display interface 24'" is a CRT of a computer display having the BPM display 30 thereon. In addition to the previously described features, this display interface 24'" also contains a BPM range selection button 246, which allows the user to select one of three BPM ranges within which to find the BPM of a music piece. In the preferred embodiment, there is a low range 248 which represents 50–95 BPM a medium range 250 which represents 80–150 BPM, and a high range 252 which represents 130–199 BPM. The ranges 248, 250, 252 are selected so that the top of each range is always less than twice the lower end of each range, so that no BPM within a range is exactly twice the other. It should be apparent that the BPM range selection button 246 can be used in any of the other displays heretofore described.

The peripheral system 10 also shows a second display interface 24", which is an interface suitable for use with a sampler. A sampler is commonly used to store a few seconds of the audio signal 18 which can be overlaid with other music pieces. Often these few seconds of the audio signal 18 are looped or stuttered synchronously to the music piece. In such circumstances, the sampler usually provides RAM buffering for storage of the few seconds of the audio signal 18.

When the detector device 14 is integrated into a sampler to form the peripheral system 10, the detector device 14 can further supplement the functions already performed by the sampler. The detector device 14 can also enable the user to more specifically describe what fractions of the music piece it wishes to repeat, delete, overlay, or other features well known in the art, using the play/pause button and other features previously described.

The display interface 24" for a sampler integrated within the peripheral system 10 or in electrical communication therewith includes the marching bar graph 180 and BPM display 30 as well as many of the other display and control features earlier described. One additional element of the display interface 24" adapted to be used with the sampler is a segmentation dial 242. The segmentation dial 242 allows the user to select an exact amount of how much of one music piece the user wishes to sample in the sampler. The segmentation dial 242 will automatically sample the precise amount of beats or time that user chooses or will allow the user to manually accept portions of the music piece by toggling a sample button 244 when the segmentation dial 242 is on manual.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

The embodiments of the invention in which an exclusive property or privilege is claimed are defined as follows:

1. An audio system for determining a tempo of an audio signal having sound impacts, the sound impacts having an average power and a portion of the sound impacts defining a sound impact pattern representative of the sound impacts of the audio signal over time, the audio system comprising a programmed device having an input which receives the audio signal, the programmed device being responsive to the audio signal received in the input to transform the audio signal into a beats per minute signal, the beats per minute signal being near a scaled sum of selected matches of the sound impact pattern and selected matches of a predetermined note structure that has a smaller offset, the smaller offset is a products of the average power of each of the sound impacts and an offset distance of the sound impact from the predetermined note structure.

2. A method for tracking beats of an audio signal having sound impacts comprising the steps of:

identifying time regions near selected beats of the audio signal to search for the sound impacts;

providing a maximum beat shift region near each of the selected beats, where the maximum beat shift region is less than the time regions;

identifying a relative displacement of a portion of the sound impacts from the selected beats;

shifting subsequent beats the lesser of the relative displacement and half the maximum beat shift region when the sound impact falls within the time regions.

3. A method according to claim 2 further comprising the step of selectively modifying the maximum beat shift region near the subsequent beats based upon the relative displacement.

4. A method according to claim 2 further comprising the step of selectively modifying the time regions near the subsequent beats based upon the relative displacement.

5. A method according to claim 2 wherein the beats include off beats.

6. A method according to claim 2 further comprising the steps of:

identifying time regions near selected off beats of the audio signal to search for the sound impacts;

providing a maximum beat shift region near each of the selected off-beats beats, where the maximum beat shift region is less than the time regions;

identifying a relative displacement of a portion of the sound impacts from the selected off-beats;

shifting subsequent beats and off-beats the lesser of a fraction of the relative displacement and half the maximum beat shift region when the sound impact falls within the time regions.

7. A method for determining a tempo of an audio signal, the tempo having beats per minute, the method comprising the steps of:

collecting the audio signal over a period of time, the audio signal having sound impacts, each of the sound impacts having a magnitude;

comparing selected ones of the sound impacts against at least one note structure, the at least one note structure having measures containing notes;

summing coincident matches of the sound impacts and the notes of the at least one note structure;

ascertaining repetitive locations of the sound impacts within the measures of the at least one note structure;

summing a number of the repetitive locations of the sound impacts within the measures;

scaling the coincident matches and the number of repetitive locations to each possible tempos;

ascertaining an offset difference of the sound impacts from the notes of at least one note structure and generating a offset being a sum of products of the offset distance and the magnitude of the each of the sound impacts, respectively; and selecting one of the possible tempos having a smaller offset and beats per minute near the scaled coincident matches and the number of repetitive locations.

* * * * *